US008406661B2

(12) United States Patent
Yamagishi et al.

(10) Patent No.: US 8,406,661 B2
(45) Date of Patent: Mar. 26, 2013

(54) DEVELOPING DEVICE AND IMAGE FORMING APPARATUS PROVIDED THEREWITH

(75) Inventors: Yoshihiro Yamagishi, Osaka (JP); Eiji Nimura, Osaka (JP); Takahisa Nakaue, Osaka (JP); Ikuo Makie, Osaka (JP); Masaki Hayashi, Osaka (JP); Koji Kuramashi, Osaka (JP); Kenichi Tamaki, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 294 days.

(21) Appl. No.: 12/969,991

(22) Filed: Dec. 16, 2010

(65) Prior Publication Data

US 2011/0176840 A1 Jul. 21, 2011

(30) Foreign Application Priority Data

Jan. 21, 2010 (JP) ..... 2010-010884
Jan. 21, 2010 (JP) ..... 2010-010888
Jan. 21, 2010 (JP) ..... 2010-010891
Jan. 21, 2010 (JP) ..... 2010-010893

(51) Int. Cl.
*G03G 15/09* (2006.01)

(52) U.S. Cl. ..... 399/273; 399/275

(58) Field of Classification Search ..... 399/272, 399/273, 274, 275
See application file for complete search history.

(56) References Cited

U.S. PATENT DOCUMENTS 4,244,322 A * 1/1981 Nomura et al. ..... 399/275
4,637,706 A * 1/1987 Hosoi et al. ..... 399/275
4,660,958 A * 4/1987 Egami et al. ..... 399/273
4,838,200 A * 6/1989 Hosoi et al. ..... 399/274 X
4,876,574 A * 10/1989 Tajima et al. ..... 399/275
4,887,131 A * 12/1989 Kinoshita et al. ..... 399/275
5,239,343 A * 8/1993 Sakemi et al. ..... 399/275
5,913,094 A * 6/1999 Endo ..... 399/274 X
6,021,295 A * 2/2000 Ochiai et al. ..... 399/275
6,266,507 B1 * 7/2001 Nagahama et al. ..... 399/274
6,317,576 B1 * 11/2001 Ishida et al. ..... 399/273
2008/0181676 A1 * 7/2008 Yamagishi et al. ..... 399/275

FOREIGN PATENT DOCUMENTS

JP 9-34267 2/1997
JP 2003-167426 6/2003

* cited by examiner

*Primary Examiner* — Sandra Brase
(74) *Attorney, Agent, or Firm* — Smith, Gambrell & Russell, LLP

(57) ABSTRACT

A developing device includes: a developing roller incorporating a fixed magnet body having a plurality of magnetic poles in a circumferential direction; a regulating member for regulating an amount of toner on the developing roller by means of a magnetic field formed by the regulating member and the fixed magnet body; and a magnetic-field generating member for scraping off, on an upstream of the regulating member in a rotational direction of the developing roller, toner which is not used for development on the developing roller. A relation Bm/Br>1 is satisfied, where Br represents a magnetic flux density of a distal end portion of the regulating member facing a surface of the developing roller and Bm represents a magnetic flux density of a distal end portion of the magnetic-field generating member facing the surface of the developing roller.

24 Claims, 20 Drawing Sheets

DEVELOPING DEVICE AND IMAGE FORMING APPARATUS PROVIDED THEREWITH

This application is based on Japanese Patent Application No. 2010-010884 filed on Jan. 21, 2010, No. 2010-010888 filed on Jan. 21, 2010, No. 2010-010891 filed on Jan. 21, 2010, and No. 2010-010893 filed on Jan. 21, 2010, the entire contents of which are incorporated herein by reference.

BACKGROUND OF THE INVENTION

1. Field of the Invention

The present invention relates to a developing device used in an image forming apparatus such as an electrophotographic copier, a printer, a facsimile, and a multifunction peripheral having functions of those devices, and to an image forming apparatus provided with the developing device.

2. Description of Related Art

In image forming apparatus, an electrostatic latent image formed on a photosensitive member is developed by a developing device and visualized as a toner image. As an example of the developing device, there has been practically used a small-sized and inexpensive developing device using a magnetic one-component developer. The developing device is provided with a fixed magnet body having a plurality of magnetic poles provided in a developing sleeve serving as a toner carrier and a regulating member for regulating an amount of toner on the developing sleeve. With this, a predetermined amount of a toner thin layer is carried on the developing sleeve between the regulating member and the developing sleeve.

As an example of the developing device just described above, there has been well-known a developing device according to a first related art in which the toner thin layer is uniformly formed on the developing sleeve.

In the developing device according to the first related art, the regulating member is provided at a predetermined interval with respect to the developing sleeve, and includes a magnet constituted by a plate-like blade made of a magnetic material. A magnetic pole of the magnet, which is on a facing side with respect to the developing sleeve, has the same polarity as that of a facing magnetic pole of the fixed magnet body in the developing sleeve, and is attached on an upstream of the blade in a rotational direction of the developing sleeve. A magnetic force of the magnet causes a distal end portion of the blade to be magnetized in reverse polarity to that of the magnet. With this structure, charged toner is conveyed in a state of adhering to the developing sleeve, and thinned by being regulated in layer thickness by the distal end portion of the blade of the regulating member. In this case, a magnetic field is formed by the fixed magnet body and the magnet between the distal end portion of the blade and the developing sleeve, and a magnetic field is formed also between the distal end portion of the blade and the magnet. Those magnetic fields allows the toner to pass between the distal end portion of the blade and the developing sleeve in a substantially uniform state, with the result that a toner thin layer is formed on the developing sleeve.

However, in the developing device according to the first related art, the magnetic forces of the magnet of the regulating member and the fixed magnet body in the developing sleeve are liable to be smaller on end portions than those on central portions in longitudinal directions thereof. Thus, between the regulating member and the developing sleeve, there is a risk that magnetic fields are weakened on the end portion sides in comparison with the central portions in the longitudinal directions. When the magnetic fields are weakened on the end portion sides, a toner regulating force on the end portion sides is lowered. A toner charging amount on the developing sleeve increases in accordance with rotation of the developing sleeve. When the toner charging amount increases, toner firmly adheres to the developing sleeve, and toner particles adsorb to each other. As a result, after repeated development, at the time of passing between the regulating member and the developing sleeve, even when the toner has a predetermined layer thickness on the central portion in the longitudinal direction, a toner layer thickness increases on the end portion sides owing to weakness of the toner regulating force. As a result, disturbance of the toner layer is liable to occur. When the toner is supplied to a photosensitive member under a state in which the disturbance of the toner layer markedly appears and the toner layer thickness is uneven, there is a problem in that satisfactory toner images are not formed on the photosensitive member.

Under the circumstance, in order to overcome the disturbance of the toner layer just described above, in a developing device according to a second related art, there is provided a magnetic-field generating member constituted by a magnet. On an upstream in the rotational direction of the developing sleeve with respect to the regulating member, the magnetic-field generating member is provided at a position facing inter-magnetic-pole portions of the fixed magnet body in the developing sleeve so as to form a magnetic brush of the toner at the position. With this structure, residual toner still remaining on the developing sleeve after development is scraped off from the developing sleeve by the magnetic brush. Then, toner is re-carried on the developing sleeve, and the toner carried thereon is conveyed to a regulating member side.

In the developing device according to the second related art, an excessively large magnetic field of the regulating member causes a thickness of the toner layer formed on the developing sleeve to be small, and hence an amount of toner supplied from the developing sleeve to the photosensitive member is reduced. As a result, sufficient image density cannot be obtained. As a countermeasure, it is necessary to set the magnetic field of the regulating member to have a predetermined value so that toner has an appropriate layer thickness. When toner caused to adhere by the magnetic field of the regulating member is scraped off with use of the magnetic-field generating member after development, an excessively large magnetic field of the magnetic-field generating member causes the toner to be subjected to stress, with the result that toner characteristics such as charging characteristics are deteriorated. Meanwhile, an excessively small magnetic field of the magnetic-field generating member causes the adhering toner to be left on the developing sleeve. Thus, after repeated development, the toner layer thickness varies in the longitudinal direction, and the disturbance of the toner layer markedly appears. In addition, when the toner adheres on the developing sleeve and left thereon, there is a problem in that a development ghost is generated owing to a difference in charging amount between the adhering toner and newly supplied toner.

Further, in the developing device according to the second related art, when the magnetic-field generating member constituted by a magnet is extended in the longitudinal direction of the developing sleeve and attached to the developing container, there is a risk that the interval between the developing sleeve and the magnetic-field generating member cannot be uniform in the longitudinal direction depending on a dimensional accuracy between the magnetic-field generating member and a member such as a developing container or a dimensional accuracy between the developing sleeve and the magnetic-field generating member. Such non-uniformity of the interval causes the magnetic field between the developing sleeve and the magnetic-field generating member to be unstable, and hence toner on the developing sleeve cannot be sufficiently scraped off.

Further, in the developing device according to the second related art, in order to sufficiently scrape off the toner layer having a large thickness on the end portion sides on the developing sleeve, it is necessary to increase the magnetic force of the magnetic-field generating member or to reduce the interval between the magnetic-field generating member and the surface of the developing sleeve. In this way, the magnetic force thus increased or the interval thus reduced makes it possible to scrape off the toner on the end portion sides on the developing sleeve. However, the toner layer thickness is relatively small on the central portion side, and the toner layer thickness varies in the longitudinal direction. Thus, when passing the interval between the magnetic-field generating member and the developing sleeve, there is a problem in that the toner is deteriorated by being subjected to stress, and in that toner particles aggregate and damage the surface of the developing sleeve. Further, image failures of vertical streak occur.

SUMMARY OF THE INVENTION

The present invention has been made to provide a developing device and an image forming apparatus provided therewith, the developing device providing satisfactory images by effecting control so that the magnetic field of the magnetic-field generating member is appropriately formed with respect to the regulating member and a developer on the developing roller is reliably scraped off, to thereby suppress disturbance of a developer layer and a development ghost, and by regulating the developer to have a predetermined layer thickness on the developing roller by means of the regulating member.

Further, it is an object of the present invention to provide a developing device and an image forming apparatus provided therewith, the developing device providing satisfactory images without disturbance of the developer layer on the developing roller by reliably scraping off the developer on the developing roller.

A developing device according to one aspect of the present invention includes: a developing roller incorporating a fixed magnet body having a plurality of magnetic poles in a circumferential direction, for supplying developer to a developing region facing an image carrier; a regulating member for regulating an amount of developer on the developing roller so as to form a developer layer region on the developing roller by means of a magnetic field formed by the regulating member and the plurality of magnetic poles of the fixed magnet body, which face the regulating member; and a magnetic-field generating member for scraping off, on an upstream of the regulating member in a rotational direction of the developing roller, developer which is not used for development on the developing roller, in which the following relation $Bm/Br>1$ is satisfied, where Bm represents a magnetic flux density of a distal end portion of the magnetic-field generating member facing a surface of the developing roller and Br represents a magnetic flux density of a distal end portion of the regulating member facing the surface of the developing roller.

Further, a developing device according to another aspect of the present invention includes: a developing roller incorporating a fixed magnet body having a plurality of magnetic poles in a circumferential direction, for supplying developer to a developing region facing an image carrier; a regulating member for regulating an amount of developer on the developing roller so as to form a developer layer region on the developing roller by means of a magnetic field formed by the regulating member and the plurality of magnetic poles of the fixed magnet body, which face the regulating member; and a magnetic-field generating member for scraping off, on an upstream of the regulating member in a rotational direction of the developing roller, developer which is not used for development on the developing roller, in which: the magnetic-field generating member includes: magnetic-field generating end portions facing both-end-portions in a longitudinal direction of the developer layer region; and a magnetic-field generating central portion sandwiched in the longitudinal direction between the magnetic-field generating end portions; and an interval between each of the magnetic-field generating end portions and a surface of the developing roller is smaller than an interval between the magnetic-field generating central portion and the surface of the developing roller.

Still further, a developing device according to another aspect of the present invention includes: a developing roller incorporating a fixed magnet body having a plurality of magnetic poles in a circumferential direction, for supplying developer to a developing region facing an image carrier; a regulating member for regulating an amount of developer on the developing roller so as to form a developer layer region on the developing roller by means of a magnetic field formed by the regulating member and the plurality of magnetic poles of the fixed magnet body, which face the regulating member; and a magnetic-field generating member for scraping off, on an upstream of the regulating member in a rotational direction of the developing roller, developer which is not used for development on the developing roller, in which: the magnetic-field generating member includes: magnetic-field generating end portions facing both-end-portions in a longitudinal direction of the developer layer region; and a magnetic-field generating central portion sandwiched in the longitudinal direction between the magnetic-field generating end portions; and each of the magnetic-field generating end portions has a magnetic force higher than a magnetic force of the magnetic-field generating central portion.

Still further, a developing device according to another aspect of the present invention includes: a developing roller incorporating a fixed magnet body having a plurality of magnetic poles in a circumferential direction, for supplying developer to a developing region facing an image carrier; a regulating member for regulating an amount of developer on the developing roller so as to form a developer layer region on the developing roller by means of a magnetic field formed by the regulating member and the plurality of magnetic poles of the fixed magnet body, which face the regulating member; and a magnetic-field generating member for scraping off, on an upstream of the regulating member in a rotational direction of the developing roller, developer which is not used for development on the developing roller, in which the magnetic-field generating member includes a pair of magnetic-field generating members arranged so as to face both-end-portions in a longitudinal direction of the developer layer region, the pair of magnetic-field generating members respectively having inner surface portions arranged so as to face each other in the developer layer region, and outer surface portions arranged out of the developer layer region or arranged so as to face boundaries of the developer layer region.

Further features and advantages of the present invention will become apparent from the description of embodiments given below.

DETAILED DESCRIPTION OF PREFERRED EMBODIMENTS

In the following, although embodiments of the present invention are described with reference to drawings, the present invention is not limited to the embodiments. Further, use of the present invention, terms used herein, and the like are not limited to the embodiments as well.

(First Embodiment)

Figure 1:
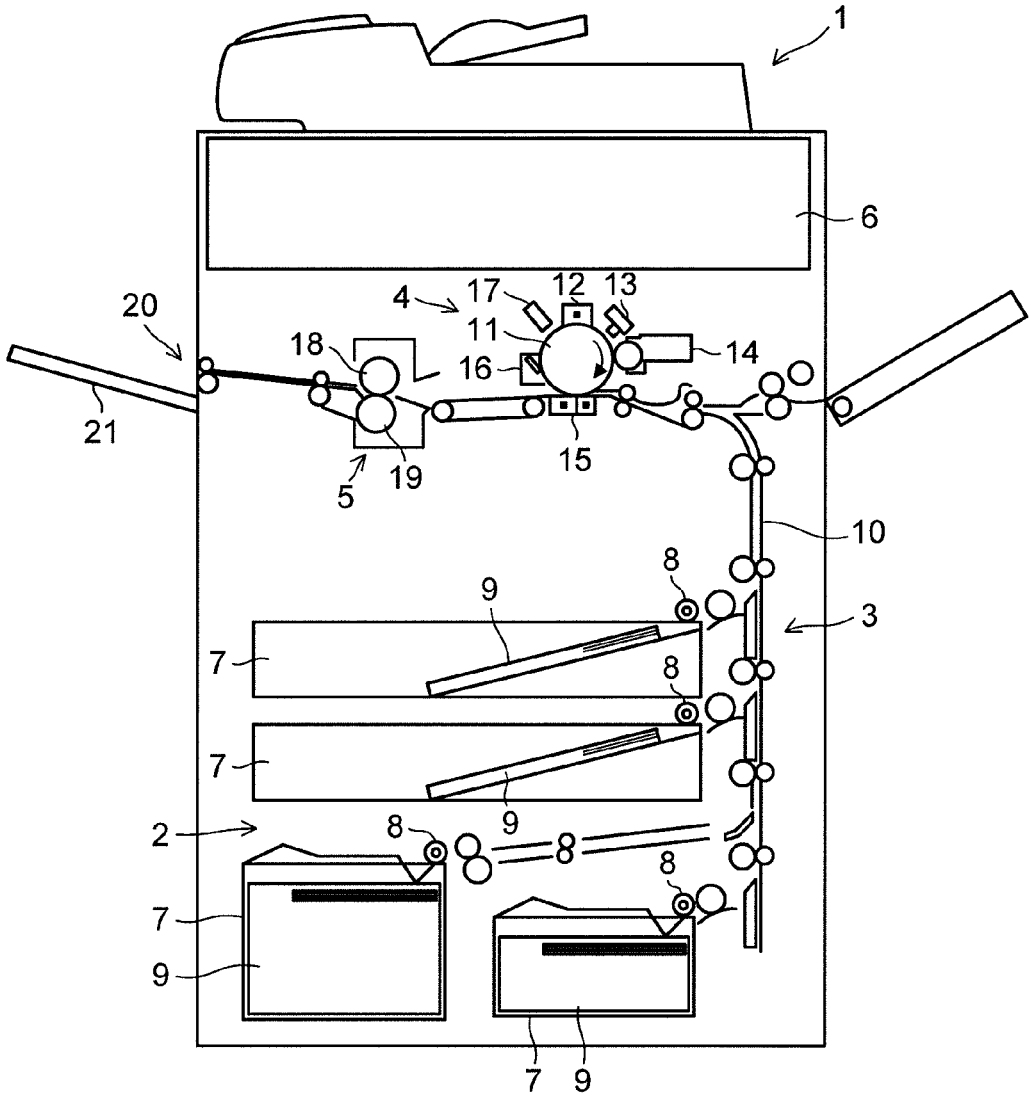
FIG. 1 is a schematic structural view of an image forming apparatus provided with a developing device according to a first embodiment of the present invention.

FIG. 1 is a schematic structural view of an image forming apparatus provided with a developing device according to this embodiment of the present invention. An image forming apparatus 1 is provided with a sheet feeding portion 2 arranged in a lower portion thereof, a sheet conveying portion 3 arranged lateral to the sheet feeding portion 2, an image forming portion 4 arranged above the sheet conveying portion 3, a fixing portion 5 arranged on a delivery side relative to the image forming portion 4, and a image reading portion 6 arranged above the image forming portion 4 and the fixing portion 5.

The sheet feeding portion 2 is provided with a plurality of sheet feeding cassettes 7 for receiving sheets 9, and sends out, by rotation operation of a sheet feeding roller 8, the sheets 9 one by one from selected one of the plurality of sheet feeding cassettes 7 to the sheet conveying portion 3.

The sheets 9 sent to the sheet conveying portion 3 are conveyed to the image forming portion 4 by way of a sheet feeding path 10. The image forming portion 4 forms a toner images on each of the sheets 9 with an electrophographic process, and is provided with a photosensitive member 11 rotatably and axially supported in the arrow direction of FIG. 1, and the following provided around the photosensitive member 11 along a rotational direction thereof: a charging portion 12, an exposure portion 13, a developing device 14, a transfer portion 15, a cleaning portion 16, and a destaticizing portion 17.

The charging portion 12 is provided with a charging wire applied with high voltage. When corona discharge from the charging wire imparts a predetermined potential to a surface of the photosensitive member 11, the surface of the photosensitive member 11 is uniformly charged. Then, when a light beam based on image data of an original document read by the image reading portion 6 is applied to the photosensitive member 11 by the exposure portion 13, a surface potential of the photosensitive member 11 is selectively attenuated, and an electrostatic latent image is formed on the surface of the photosensitive member 11. Next, the developing device 14 develops the electrostatic latent image on the surface of the photosensitive member 11, and a toner image is formed on the surface of the photosensitive member 11. The transfer portion 15 transfers the toner image onto each of the sheets 9 fed between the photosensitive member 11 and the transfer portion 15.

The sheets 9 onto each of which the toner image is transferred are conveyed to the fixing portion 5 arranged on a downstream in a sheet conveying direction of the image forming portion 4. In the fixing portion 5, a heating member 18 and a pressure roller 19 respectively heats and pressurizes the sheets 9, and the toner image is melt-fixed to each of the sheets 9. Next, each of the sheets 9 onto which the toner image is fixed is delivered onto a delivery tray 21 by a delivery roller pair 20. After transfer by the transfer portion 15, the cleaning portion 16 removes residual toner on the surface of the photosensitive member 11, and the destaticizing portion 17 removes residual charge on the surface of the photosensitive member 11. Then, the charging portion 12 recharges the photosensitive member 11, and image formation is sequentially performed as described above.

Figure 2:
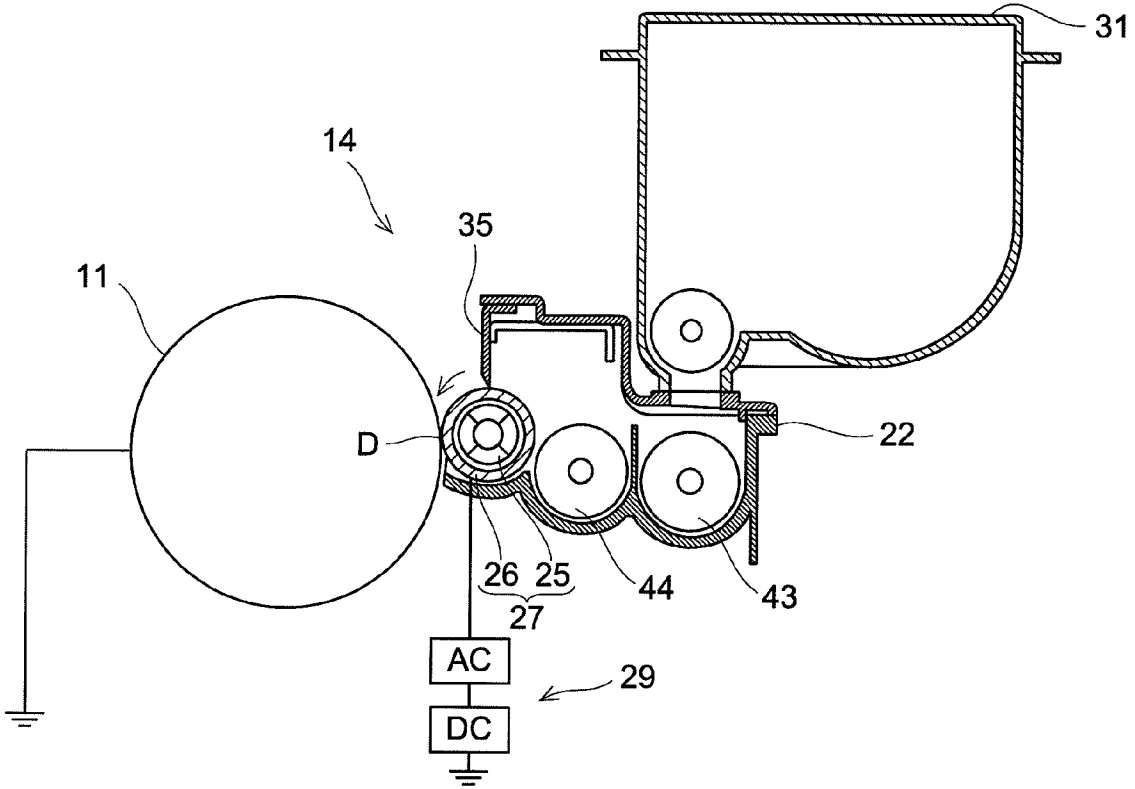
FIG. 2 is a sectional side view of the schematic structure of the developing device according to the first embodiment of the present invention.

Next, description is made of the developing device with reference to FIG. 2. FIG. 2 is a sectional side view of the schematic structure of the developing device used for the 1 image forming apparatus.

The developing device 14 is provided with a developing container 22 for storing a magnetic one-component developer, stirring members 43 and 44 for stirring the developer (hereinafter, sometimes referred to as "toner"), a developing roller 27, and a regulating member 35. A toner container 31 supplies the toner to the developing device 14.

The stirring members 43 and 44 are rotatably arranged in the developing container 22, and stirs and circulates the toner before supplying it to the developing roller 27.

The developing roller 27 is provided with a fixed magnet body 25 and a developing sleeve 26. The developing sleeve 26 is constituted by a cylindrical non-magnetic member, and rotatably supported by the developing container 22 adjacent to the stirring member 44. The fixed magnet body 25 is constituted by a permanent magnet fixedly provided in the developing sleeve 26, and generates a magnetic field toward the developing sleeve 26. Further, the developing roller 27 is exposed from an opening of the developing container 22, and faces the photosensitive member 11 serving as an image carrier at a fixed interval. This region facing the photosensitive member 11 constitutes a developing region D for supplying toner carried on the developing sleeve 26 to the photosensitive member 11. Further, in order to supply the toner to the photosensitive member 11, the developing sleeve 26 is applied with a developing bias 29 obtained by superimposition of an alternating voltage onto a direct voltage.

The regulating member 35 is provided for regulating the toner carried on a surface of the developing sleeve 26 so that the toner has a predetermined layer thickness, and attached to the developing container 22 substantially above the developing sleeve 26 at a predetermined interval with respect to the surface of the developing sleeve 26.

By a magnetic force of the fixed magnet body 25 in the developing sleeve 26, the toner supplied from the stirring member 44 is carried on the surface of the developing sleeve 26. The toner carried thereon is regulated by the regulating member 35 so as to have a predetermined layer thickness, and conveyed to the developing region D by rotation of the developing sleeve 26 (rotation in the arrow direction of FIG. 2). By application of the developing bias 29 to the developing sleeve 26, a potential difference is generated between the developing sleeve 26 and the photosensitive member 11 in the developing region D. As a result, the toner on the developing sleeve 26 is supplied to the photosensitive member 11, and the electrostatic latent image on the photosensitive member 11 is developed into a toner image.

Figure 3:
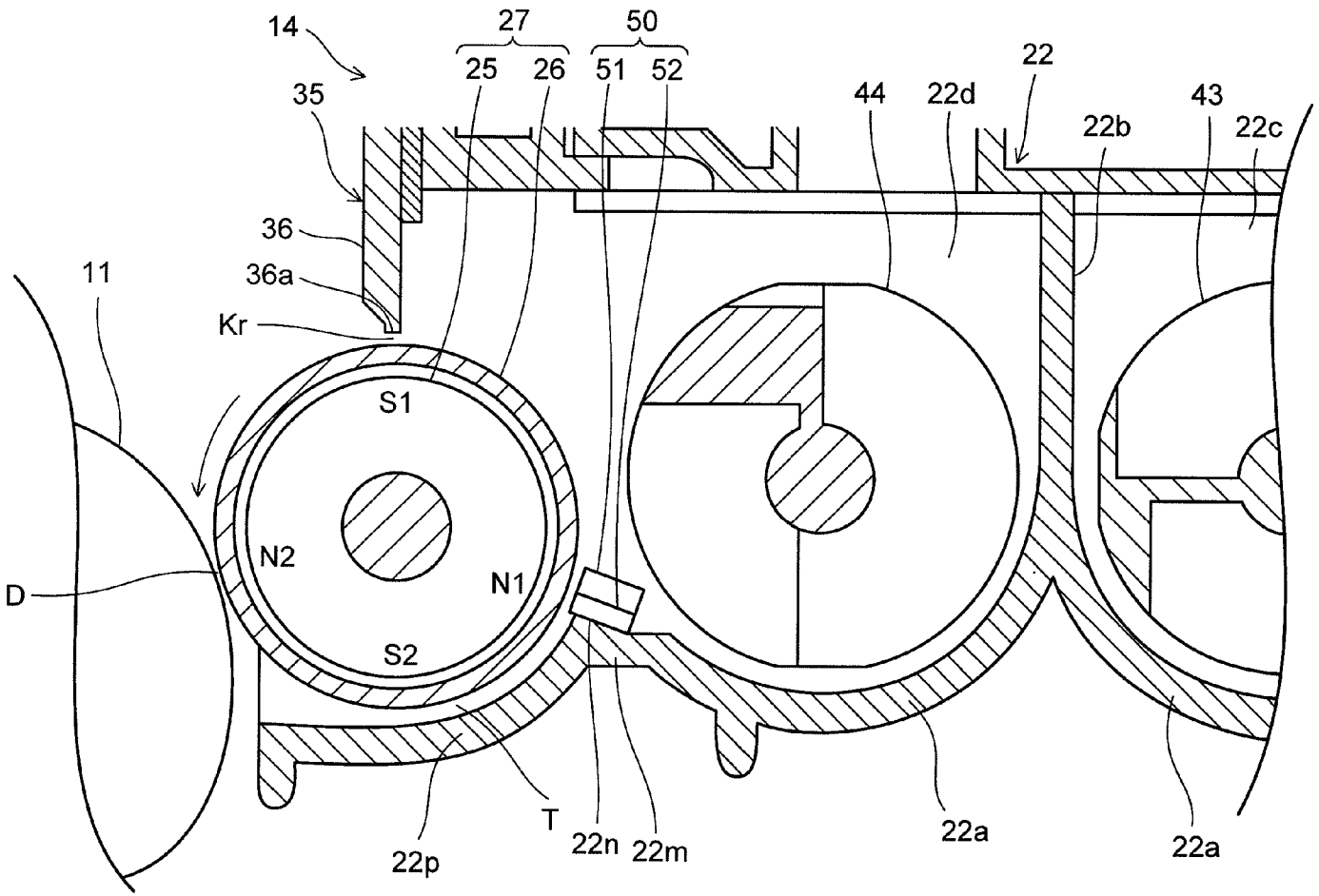
FIG. 3 is a sectional side view of a main-portion structure of the developing device according to the first embodiment of the present invention.
Figure 4:
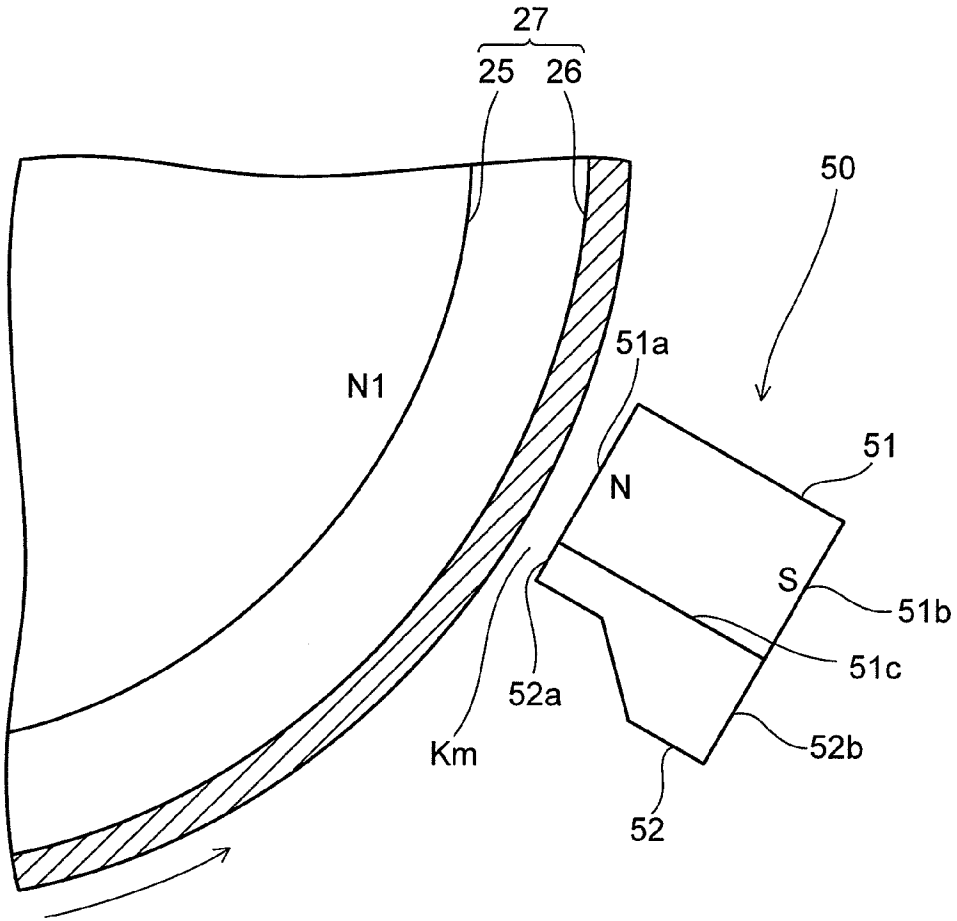
FIG. 4 is a side view of a magnetic-field generating member of the developing device according to the first embodiment of the present invention.

Next, detailed description is made of the developing device 14 with reference to FIGS. 3 and 4. FIG. 3 is a sectional side view of a main-portion structure of the developing device, and FIG. 4 is a side view of the magnetic-field generating member.

As illustrated in FIG. 3, the developing container 22 is made of a resin and an inner wall portion of the container includes developer storage portions 22*a* for storing toner, a developer supplying portion 22*p* for storing toner and supplying the toner to the photosensitive member 11, and an adjacent portion 22*m* interposed between one of the developer storage portions 22*a* and the developer supplying portion 22*p* below the developing container 22.

Each of the developer storage portions 22*a* is provided with one of conveyance paths 22*c* and 22*d*, the two stirring members 43 and 44 being arranged respectively in the conveyance paths 22*c* and 22*d* with a partition portion 22*b* being interposed therebetween. Each of the stirring members 43 and 44 is provided with a spindle rotatably supported in the developer storage portion 22*a* and a blade helically formed in an axial direction of the spindle. Toner supplied from the toner container 31 (refer to FIG. 2) to the conveyance path 22*c* is stirred by rotation of the stirring member 43, and the stirred toner is conveyed to the conveyance path 22*d* through openings provided at both end portions of the partition portion 22*b*. Further, in the conveyance path 22*d*, the toner is stirred by rotation of the stirring member 44 so as to circulate in the conveyance paths 22*c* and 22*d*. Then, the stirred toner is supplied from the conveyance path 22*d* to the developing sleeve 26.

In the developer supplying portion 22*p*, the developing sleeve 26 is rotatably arranged. The developing sleeve 26 is cylindrically made of a non-magnetic material such as aluminum. In the developing sleeve 26, the fixed magnet body 25 is fixedly supported in the developer supplying portion 22*p*. The fixed magnet body 25 has S poles and N poles alternately arranged in a circumferential direction, and generates a magnetic field toward the surface of the developing sleeve 26.

A magnetic pole S1 of the fixed magnet body 25 is arranged at a position facing the regulating member 35. Further, a magnetic pole N2 of the fixed magnet body 25 is arranged at a position facing the developing region D. Still further, a magnetic pole S2 of the fixed magnet body 25 is arranged in a toner circulating region T in which residual toner after development is conveyed. Yet further, a magnetic pole N1 of the fixed magnet body 25 is arranged at a position facing the adjacent portion 22*m*.

The regulating member 35 has a regulating blade 36 made of a magnetic plate member such as stainless steel.

The regulating blade 36 is attached to the developing container 22 substantially above the developing sleeve 26. The regulating blade 36 has a distal end portion 36*a* having an edge shape and facing the surface of the developing sleeve 26 at a predetermined interval Kr with respect to the surface of the developing sleeve 26. Further, the distal end portion 36*a* of the regulating blade 36 faces the magnetic pole S1 of the fixed magnet body 25 in the developing sleeve 26.

With this structure, by the magnetic force of the magnetic pole S1 of the fixed magnet body 25, the distal end portion 36*a* of the regulating blade 36 is magnetized in reverse polarity (N pole) to the magnetic pole S1 of the fixed magnet body 25. As a result, a magnetic field is formed between the distal end portion 36*a* of the regulating blade 36 and the developing sleeve 26. In this context, the distal end portion 36*a* of the regulating blade 36 is configured to have a magnetic flux density Br. The magnetic flux density Br allows toner to pass through the interval Kr in a substantially uniform state, and a toner thin layer is formed on the developing sleeve 26.

Note that, the regulating member 35 may include the regulating blade 36 and a permanent magnet. In this case, the permanent magnet is attached on an upstream in a rotational direction of the developing roller with respect to the regulating blade 36, and a facing end portion of the permanent magnet with respect to the developing sleeve 26 is configured to have a S pole with the same polarity as that of the magnetic pole S1 of the fixed magnet body 25 in the developing sleeve 26.

The adjacent portion 22*m* includes an attachment portion 22*n* constituting a surface to which a magnetic-field generating member 50 is attached. The magnetic-field generating member 50 includes a magnet 51 and a magnetic body 52, and faces the surface of the developing sleeve 26 at a fixed interval when being attached to the attachment portion 22*n*. Then, the magnetic-field generating member 50 faces the magnetic pole N1 of the fixed magnet body 25 through intermediation of the developing sleeve 26, and generates a magnetic field between the magnetic-field generating member 50 and the magnetic pole N1 of the fixed magnet body 25.

Next, detailed description is made of the magnetic-field generating member with reference to FIG. 4. As described above, the magnetic-field generating member 50 includes the magnet 51 and the magnetic body 52.

The magnet 51 is a permanent magnet, and faces the surface of the developing sleeve 26 at a fixed interval. Further, the magnet 51 includes a facing magnetic pole 51*a* facing the magnetic pole N1 (N pole) of the fixed magnet body 25 through intermediation of the developing sleeve 26, and an opposite magnetic pole 51*b* positioned on an opposite side to the facing magnetic pole 51*a* in a normal direction of the developing sleeve 26. The facing magnetic pole 51*a* has the same polarity (N pole) as that of the magnetic pole N1 of the fixed magnet body 25, and the opposite magnetic pole 51*b* is an S pole. Further, the magnet 51 has a rectangular shape in cross-section, and includes a facing portion 51*c* positioned on the upstream in the rotational direction of the developing roller.

The magnetic body 52 is made of a magnetic material such as stainless steel, and firmly attached by adhesive to the facing portion 51*c* of the magnet 51. Further, the magnetic body 52 includes a distal end portion 52*a* and an opposite facing portion 52*b*. The distal end portion 52*a* faces the surface of the developing sleeve 26 at an interval Km with respect to the surface of the developing sleeve 26. The interval Km is set to be smaller than the interval Kr between the distal end portion of the regulating member 35 (refer to FIG. 3) and the surface of the developing sleeve 26. Specifically, the interval Kr with respect to the regulating member 35 is set to 0.35 mm, and the interval Km with respect to the magnetic body 52 is set to 0.2 mm. With this, residual toner after development on the developing sleeve 26 is reliably scraped off, and a toner layer having a predetermined thickness is formed on the developing sleeve 26, with the result that an appropriate amount of toner is supplied to the photosensitive member 11. An interval ratio Km/Kr is preferred to fall within a range of from 0.3 to 0.7.

The opposite facing portion 52*b* is positioned on an opposite side to the distal end portion 52*a* in the normal direction of the developing sleeve 26, and formed to be flush with a flat surface of the opposite magnetic pole 51*b* of the magnet 51. Note that, in this embodiment, although the magnetic body 52 is attached on an upstream of the magnet 51 in the rotational direction of the developing roller, this should not be construed restrictively. The magnetic body 52 may be attached on a downstream of the magnet 51 in the rotational direction of the developing roller.

With this structure, the distal end portion 52*a* of the magnetic body 52 is magnetized to have an S pole, and the opposite facing portion 52*b* is magnetized to have an N pole. Accordingly, the magnetic body 52 forms a magnetic path constituted by magnetic lines of force between the magnetic body 52 and the magnet 51, and the magnetic body 52 forms a magnetic path constituted by magnetic lines of force between the magnetic body 52 and the fixed magnet body 25.

In other words, the opposite facing portion 52*b* of the magnetic body 52 is magnetized to have an N pole. Thus, there are formed magnetic lines of force passing between the opposite facing portion 52*b* of the magnetic body 52 and the opposite magnetic pole (S pole) 51*b* of the magnet 51, and there are formed magnetic lines of force passing between the opposite facing portion 52*b* of the magnetic body 52 and a magnetic pole (S pole) adjacent to the magnetic pole N1 of the fixed magnet body 25.

Further, in the circumferential direction of the developing roller, the opposite facing portion 52*b* of the magnetic body 52 is formed to have a width larger than a width of the distal end portion 52*a* of the magnetic body 52. With this, a large number of magnetic lines of force are formed between the opposite facing portion 52*b* of the magnetic body 52 and the opposite magnetic pole (S pole) 51*b* of the magnet 51, and a large number of magnetic lines of force are formed between the opposite facing portion 52*b* of the magnetic body 52 and one of the magnetic poles (S poles) of the fixed magnet body 25.

Still further, the distal end portion 52*a* of the magnetic body 52 is magnetized to have an S pole, and has a relatively small width. Thus, there are intensively formed magnetic lines of force passing between the distal end portion 52*a* of the magnetic body 52 and the facing magnetic pole (N pole) 51*a* of the magnet 51, and there are intensively formed magnetic lines of force passing between the distal end portion 52*a* of the magnetic body 52 and the magnetic pole N1 of the fixed magnet body 25. In this way, the two magnetic paths each constituted by the magnetic lines of force are formed in a narrow region between the distal end portion 52*a* of the magnetic body 52 and the surface of the developing sleeve 26, with the result that density of the magnetic lines of force increases. Magnetic fields corresponding to the magnetic lines of force are generated at the distal end portion 52*a* of the magnetic body 52 and on the surface of the developing sleeve 26.

A magnetic flux density Bm of the distal end portion 52*a* of the magnetic body 52 thus formed is set to be higher than the magnetic flux density Br of the distal end portion (refer to FIG. 3) of the regulating member 35. With this, residual toner after development on the developing sleeve 26 is reliably scraped off, and a toner layer having a predetermined thickness is formed on the developing sleeve 26, with the result that an appropriate amount of toner is supplied to the photosensitive member 11. A magnetic-flux-density ratio Bm/Br is preferred to fall within a range of from 1.2 to 1.8.

Note that, in the first embodiment described above, although the magnet 51 of the magnetic-field generating member 50 faces the magnetic pole N1 (N pole) of the fixed magnet body 25 through intermediation of the developing sleeve 26, the present invention is not limited thereto. Alternatively, the facing magnetic pole 51*a* of the magnet 51 may be arranged between the magnetic pole N and the magnetic pole S of the fixed magnet body 25. Also in this case, the same functions and advantages as those in the above-mentioned case can be obtained.

(Second Embodiment)

Figure 5:
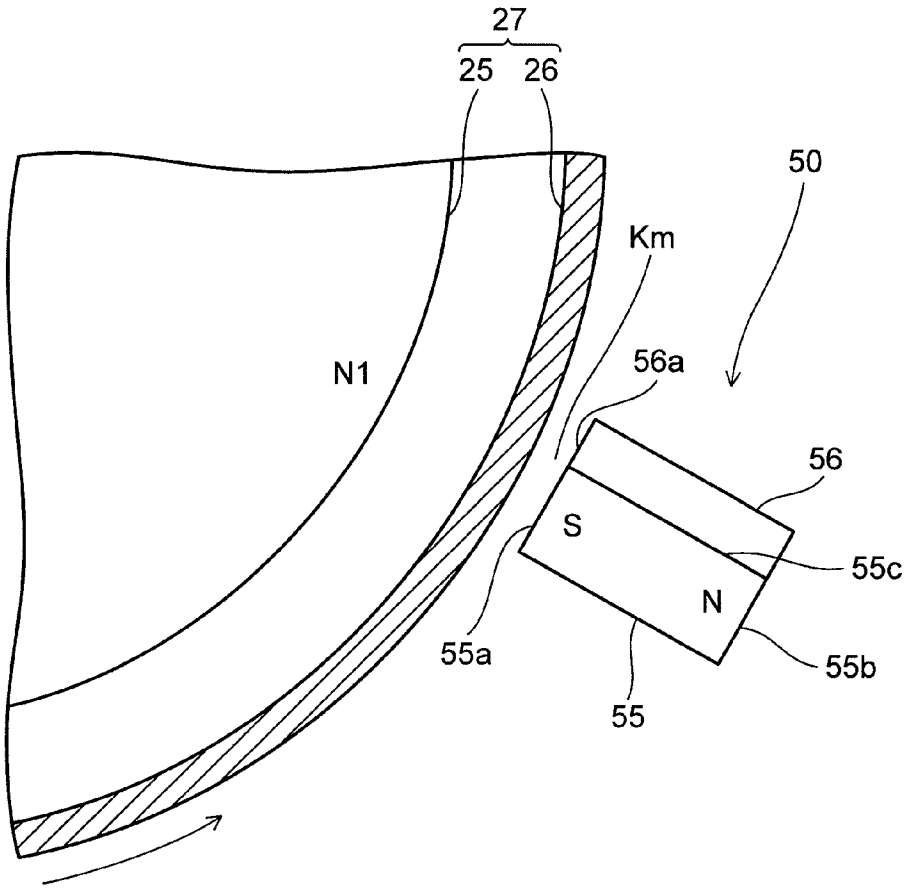
FIG. 5 is a side view of the magnetic-field generating member of a developing device according to a second embodiment of the present invention.

Next, description is made of a modification of the magnetic-field generating member with reference to FIG. 5. FIG. 5 is a side view of the magnetic-field generating member. In a second embodiment, the magnetic-field generating member 50 includes a magnet 55 and a non-magnetic body 56. In the embodiments hereinbelow, description of the same parts as those in the first embodiment is omitted.

The magnet 55 is constituted by a permanent magnet having a rectangular shape in cross-section, and includes a facing magnetic pole 55*a* facing the magnetic pole N1 (N pole) of the fixed magnet body 25 through intermediation of the developing sleeve 26, an opposite magnetic pole 55*b* positioned on an opposite side to the facing magnetic pole 55*a* in the normal direction of the developing sleeve 26, and a facing portion 55*c* positioned on the downstream in the rotational direction of the developing roller. The facing magnetic pole 55*a* has an opposite polarity (S pole) to that of the magnetic pole N1 of the fixed magnet body 25, and the opposite magnetic pole 55*b* is an N pole. Further, the facing magnetic pole 55*a* faces the surface of the developing sleeve 26 at the interval Km with respect to the surface of the developing sleeve 26. The interval Km is set to be smaller than the interval Kr between the distal end portion of the regulating member 35 (refer to FIG. 3) and the surface of the developing sleeve 26. In this way, there are formed magnetic lines of force passing between the facing magnetic pole 55*a* of the magnet 55 and the magnetic pole N1 of the fixed magnet body 25.

The non-magnetic body 56 is made of a non-magnetic material such as a stainless steel (SUS304) plate, and firmly attached by adhesive to the facing portion 55*c* of the magnet 55.

With this, residual toner after development on the developing sleeve 26 is reliably scraped off, and a toner layer having a predetermined thickness is formed on the developing sleeve 26, with the result that an appropriate amount of toner is supplied to the photosensitive member 11. The interval ratio Km/Kr is preferred to fall within a range of from 0.3 to 0.7.

A magnetic flux density Bm formed at the facing magnetic pole 55*a* of the magnet 55 and a distal end portion 56*a* of the non-magnetic body 56 is set to be higher than the magnetic flux density Br of the distal end portion (refer to FIG. 3) of the regulating member 35. With this, residual toner after development on the developing sleeve 26 is reliably scraped off, and a toner layer having a predetermined thickness is formed on the developing sleeve 26, with the result that an appropriate amount of toner is supplied to the photosensitive member 11. The magnetic-flux-density ratio Bm/Br is more preferred to fall within a range of from 1.2 to 1.8.

According to the first and second embodiments, the developing device 14 includes the following: the developing roller 27 incorporating the fixed magnet body 25 having the plurality of magnetic poles in the circumferential direction, for supplying toner to the developing region D facing the photosensitive member 11; the regulating member 35 for regulating an amount of the toner on the developing roller 27 by means of the magnetic field formed also by the fixed magnet body 25; and the magnetic-field generating member 50 for scraping off, on the upstream of the regulating member 35 in the rotational direction of the developing roller, toner which is not used for development on the developing roller 27. A relation Bm/Br>1 is satisfied where Br represents the magnetic flux density of the distal end portion of the regulating member 35 facing a surface of the developing roller 27 and Bm represents the magnetic flux density of the distal end portion of the magnetic-field generating member 50 facing the surface of the developing roller 27.

With this structure, by the magnetic flux density Bm of the distal end portion of the magnetic-field generating member 50 higher than the magnetic flux density Br of the distal end portion of the regulating member 35, the residual toner after development on the developing roller 27 is scraped off. Then, by the magnetic flux density Br of the distal end portion of the regulating member 35, a toner thin layer having a predetermined thickness is formed on the developing roller 27, and the toner thin layer is supplied to the photosensitive member 11. Accordingly, the toner on the developing roller 27 is reliably scraped off, and an appropriate amount of toner is supplied from the developing roller 27 to the photosensitive member 11 without disturbance of the toner layer or a development ghost on the developing roller 27. As a result, images of satisfactory density can be obtained.

Further, according to the first and second embodiments, a relation Km/Kr<1 is satisfied where Kr represents an interval between the distal end portion of the regulating member 35 and the surface of the developing roller 27 and Km represents an interval between the distal end portion of the magnetic-field generating member 50 and the surface of the developing roller 27. With this, after development, by the interval Km with respect to the distal end portion of the magnetic-field generating member 50 smaller the interval Kr with respect to the distal end portion of the regulating member 35, the residual toner on the developing roller 27 is scraped off. Then, the toner thin layer having a predetermined thickness is formed on the developing roller 27, and the toner thin layer is supplied to the photosensitive member 11. Accordingly, the toner on the developing roller 27 is reliably scraped off, and an appropriate amount of toner is supplied from the developing roller 27 to the photosensitive member 11 without disturbance of the toner layer or a development ghost on the developing roller 27. As a result, images of satisfactory density can be obtained.

Further, according to the first and second embodiments, when a relation 0.3>Km/Kr>0.7 is satisfied, after development, the residual toner on the developing roller 27 is scraped off. Then, the toner thin layer having a predetermined thickness is formed on the developing roller 27, and the toner thin layer is supplied to the photosensitive member 11. Accordingly, the toner on the developing roller 27 is reliably scraped off, and an appropriate amount of toner is supplied from the developing roller 27 to the photosensitive member 11 without disturbance of the toner layer or a development ghost on the developing roller 27. As a result, images of satisfactory density can be obtained.

Further, according to the first embodiment, the magnetic-field generating member 50 includes the magnetic body 52 facing the surface of the developing roller 27 at the predetermined interval Km, and the magnet 51 which includes the facing magnetic pole 51*a* facing the magnetic pole N1 of the fixed magnet body 25 and which is attached to the magnetic body 52 while facing the magnetic body 52 in the rotational direction of the developing roller. The facing magnetic pole 51*a* of the magnet 51 has the same polarity as that of the magnetic pole N1 of the fixed magnet body 25.

With this, the distal end portion 52*a* of the magnetic body 52 is magnetized to have an opposite magnetic pole to that of the facing magnetic pole 51*a* of the magnet 51, and there are formed magnetic lines of force passing between the distal end portion 52*a* of the magnetic body 52 and the facing magnetic pole 51*a* of the magnet 51. Further, a magnetized magnetic pole of the distal end portion 52*a* of the magnetic body 52 has an opposite polarity also to that of the magnetic pole N1 of the fixed magnet body 25, and there are formed magnetic lines of force passing between the distal end portion 52*a* of the magnetic body 52 and the fixed magnet body 25. In this way, the two magnetic paths each constituted by the magnetic lines of force are formed between the distal end portion 52*a* of the magnetic body 52 and the surface of the developing roller 27. As a result, density of the magnetic lines of force increases, and residual toner after development on the surface of the developing roller 27 is scraped off in accordance with a magnitude of the magnetic flux density Bm of the distal end portion of the magnetic-field generating member 50. Accordingly, there is no disturbance of the toner layer or a development ghost on the developing roller 27, and satisfactory images can be obtained.

Further, according to the second embodiment, the magnetic-field generating member 50 includes the magnet 55 facing the magnetic pole N1 of the fixed magnet body 25 at the predetermined interval with respect to the surface of the developing roller 27, the magnet 55 facing the magnetic pole N1 of the fixed magnet body 25 while having opposite polarity. With this, the facing magnetic pole 55*a* of the magnet 55 forms the magnetic lines of force passing between the facing magnetic pole 55*a* and the magnetic pole N1 of the fixed magnet body 25, and the residual toner after development on the surface of the developing roller 27 is scraped off by the magnetic flux density in accordance with the magnetic lines of force. Accordingly, there is no disturbance of the toner layer or a development ghost on the developing roller 27, and satisfactory images can be obtained.

Note that, in the first and second embodiments, although the relation Km/Kr<1 is satisfied where Kr represents the interval between the surface of the developing roller 27 and the distal end portion of the regulating member 35 and Km represents the interval of the distal end portion of the magnetic-field generating member 50, the present invention is not limited thereto. As long as the relation Bm/Br>1 is satisfied where Br represents the magnetic flux density of the distal end portion of the regulating member 35 and Bm represents the magnetic flux density of the distal end portion of the magnetic-field generating member 50, the residual toner on the surface of the developing roller 27 can be reliably scraped off as described above even when the interval Km with respect to the magnetic-field generating member 50 is equal to or larger than the interval Kr with respect to the regulating member 35. When the relation Km/Kr<1 is satisfied simultaneously with the relation Bm/Br>1, toner can be more efficiently scraped off.

In the following, description is made of examples according to the present invention, in which the examples are further specified. Note that, the present invention is not limited only to these examples.

(Example 1)

The developing roller 27 has an outer diameter of 20 mm. The regulating blade 36 is made of stainless steel (SUS305), the interval Kr between the distal end portion 36*a* of the regulating blade 36 and the surface of the developing roller 27 is 0.3 mm, and the magnetic pole S1 of the fixed magnet body 25 facing the regulating blade 36 has a magnetic flux density of 85 mT. Meanwhile, of the magnetic-field generating member 50, the magnetic body 52 is made of stainless steel (SUS305), and the interval Km between the distal end portion 52*a* of the magnetic body 52 and the surface of the developing roller 27 is 0.3 mm. The magnet 51 is attached on the downstream of the magnetic body 52 in the rotational direction of the developing roller while facing the magnetic body 52. The facing magnetic pole 51*a* of the magnet 51 faces the magnetic pole N1 of the fixed magnet body 25, and has an N pole and a magnetic flux density of 100 mT. The magnetic pole N1 of the fixed magnet body 25 has a magnetic flux density of 85 mT.

With this structure, the magnetic flux density Br of the distal end portion 36*a* of the regulating blade 36 is 72 mT, and the magnetic flux density Bm of the distal end portion of the magnetic-field generating member 50 is 125 mT. Therefore, the magnetic-flux-density ratio Bm/Br is 1.74. As a result, residual toner on the developing roller 27 was scraped off to a lower portion of the toner layer by the magnetic-field generating member 50. A toner conveying amount from the regulating member 35 to the developing region D is 1.1 mg/cm$^2$, and a density of a developed image is 1.35. As a result, a satisfactory image was obtained.

(Example 2)

The developing roller 27 has an outer diameter of 20 mm. The regulating blade 36 is made of stainless steel (SUS305), the interval Kr between the distal end portion 36*a* of the regulating blade 36 and the surface of the developing roller 27 is 0.3 mm, and the magnetic pole S1 of the fixed magnet body 25 facing the regulating blade 36 has a magnetic flux density of 85 mT. Meanwhile, of the magnetic-field generating member 50, the magnetic body 52 is made of stainless steel (SUS305), and the interval Km between the distal end portion 52*a* of the magnetic body 52 and the surface of the developing roller 27 is 0.3 mm. The magnet 51 is attached on the downstream of the magnetic body 52 in the rotational direction of the developing roller while facing the magnetic body 52. The facing magnetic pole 51*a* of the magnet 51 faces the magnetic pole N1 of the fixed magnet body 25, and has an N pole and a magnetic flux density of 75 mT. The magnetic pole N1 of the fixed magnet body 25 has a magnetic flux density of 85 mT.

With this structure, the magnetic flux density Br of the distal end portion 36*a* of the regulating blade 36 is 72 mT, and the magnetic flux density Bm of the distal end portion of the magnetic-field generating member 50 is 90 mT. Therefore, the magnetic-flux-density ratio Bm/Br is 1.25. As a result, residual toner on the developing roller 27 was scraped off to a lower portion of the toner layer by the magnetic-field generating member 50. A toner conveying amount from the regulating member 35 to the developing region D is 1.1 mg/cm$^2$, and a density of a developed image is 1.35. As a result, a satisfactory image was obtained.

(Example 3)

The developing roller 27 has an outer diameter of 20 mm. The regulating blade 36 is made of stainless steel (SUS305), the interval Kr between the distal end portion 36*a* of the regulating blade 36 and the surface of the developing roller 27 is 0.3 mm, and the magnetic pole S1 of the fixed magnet body 25 facing the regulating blade 36 has a magnetic flux density of 85 mT. Meanwhile, of the magnetic-field generating member 50, the magnetic body 52 is made of stainless steel (SUS305), and the interval Km between the distal end portion 52*a* of the magnetic body 52 and the surface of the developing roller 27 is 0.3 mm. The magnet 51 is attached on the downstream of the magnetic body 52 in the rotational direction of the developing roller while facing the magnetic body 52. The facing magnetic pole 51*a* of the magnet 51 is provided at 20 degrees above the magnetic pole N1 of the fixed magnet body 25 in the rotational direction, and has an N pole and a magnetic flux density of 100 mT. The magnetic pole N1 of the fixed magnet body 25 has a magnetic flux density of 85 mT.

With this structure, the magnetic flux density Br of the distal end portion 36*a* of the regulating blade 36 is 72 mT, and the magnetic flux density Bm of the distal end portion of the magnetic-field generating member 50 is 104 mT. Therefore, the magnetic-flux-density ratio Bm/Br is 1.44. As a result, residual toner on the developing roller 27 was scraped off to a lower portion of the toner layer by the magnetic-field generating member 50. A toner conveying amount from the regulating member 35 to the developing region D is 1.1 mg/cm$^2$, and a density of a developed image is 1.35. As a result, a satisfactory image was obtained.

(Example 4)

The developing roller 27 has an outer diameter of 20 mm. The regulating blade 36 is made of stainless steel (SUS305), the interval Kr between the distal end portion 36*a* of the regulating blade 36 and the surface of the developing roller 27 is 0.3 mm, and the magnetic pole S1 of the fixed magnet body 25 facing the regulating blade 36 has a magnetic flux density of 85 mT. Meanwhile, of the magnetic-field generating member 50, the magnetic body 52 is made of stainless steel (SUS305), and the interval Km between the distal end portion 52*a* of the magnetic body 52 and the surface of the developing roller 27 is 0.3 mm. The magnet 51 is attached on the upstream of the magnetic body 52 in the rotational direction of the developing roller while facing the magnetic body 52. The facing magnetic pole 51*a* of the magnet 51 faces the magnetic pole N1 of the fixed magnet body 25, and has an N pole and a magnetic flux density of 100 mT. The magnetic pole N1 of the fixed magnet body 25 has a magnetic flux density of 85 mT.

With this structure, the magnetic flux density Br of the distal end portion 36*a* of the regulating blade 36 is 72 mT, and the magnetic flux density Bm of the distal end portion of the magnetic-field generating member 50 is 123 mT. Therefore, the magnetic-flux-density ratio Bm/Br is 1.71. As a result, residual toner on the developing roller 27 was scraped off to a lower portion of the toner layer by the magnetic-field generating member 50. A toner conveying amount from the regulating member 35 to the developing region D is 1.1 mg/cm$^2$, and a density of a developed image is 1.35. As a result, a satisfactory image was obtained.

(Example 5)

The developing roller 27 has an outer diameter of 20 mm. The regulating blade 36 is made of stainless steel (SUS305), the interval Kr between the distal end portion 36*a* of the regulating blade 36 and the surface of the developing roller 27 is 0.3 mm, and the magnetic pole S1 of the fixed magnet body 25 facing the regulating blade 36 has a magnetic flux density of 85 mT. Meanwhile, of the magnetic-field generating member 50, the non-magnetic body 56 is made of stainless steel (SUS304). The magnet 55 is attached on the upstream of the non-magnetic body 56 in the rotational direction of the developing roller while facing the non-magnetic body 56. The facing magnetic pole 55*a* of the magnet 55 faces the magnetic pole N1 of the fixed magnet body 25, and has an S pole and a magnetic flux density of 100 mT. The interval Km between the facing magnetic pole 55*a* of the magnet 55 and the surface of the developing roller 27 is 0.3 mm. The magnetic pole N1 of the fixed magnet body 25 has a magnetic flux density of 85 mT.

With this structure, the magnetic flux density Br of the distal end portion 36*a* of the regulating blade 36 is 72 mT, and the magnetic flux density Bm of the distal end portion of the magnetic-field generating member 50 is 108 mT. Therefore, the magnetic-flux-density ratio Bm/Br is 1.5. As a result, residual toner on the developing roller 27 was scraped off to a lower portion of the toner layer by the magnetic-field generating member 50. A toner conveying amount from the regulating member 35 to the developing region D is 1.1 mg/cm$^2$, and a density of a developed image is 1.35. As a result, a satisfactory image was obtained.

(Comparative Example)

The developing roller 27 has an outer diameter of 20 mm. The regulating blade 36 is made of stainless steel (SUS305), the interval Kr between the distal end portion 36*a* of the regulating blade 36 and the surface of the developing roller 27 is 0.3 mm, and the magnetic pole S1 of the fixed magnet body 25 facing the regulating blade 36 has a magnetic flux density of 85 mT. Meanwhile, of the magnetic-field generating member 50, the magnetic body 52 is made of stainless steel (SUS305), and the interval Km between the distal end portion 52*a* of the magnetic body 52 and the surface of the developing roller 27 is 0.4 mm. The magnet 51 is attached on the downstream of the magnetic body 52 in the rotational direction of the developing roller while facing the magnetic body 52. The facing magnetic pole 51*a* of the magnet 51 faces the magnetic pole N1 of the fixed magnet body 25, and has an N pole and a magnetic flux density of 45 mT. The magnetic pole N1 of the fixed magnet body 25 has a magnetic flux density of 85 mT.

With this structure, the magnetic flux density Br of the distal end portion 36*a* of the regulating blade 36 is 72 mT, and the magnetic flux density Bm of the distal end portion of the magnetic-field generating member 50 is 60 mT. Therefore, the magnetic-flux-density ratio Bm/Br is 0.83. As a result, residual toner on the developing roller 27 was insufficiently scraped off, that is, not scraped off to a lower portion of the toner layer by the magnetic-field generating member 50, and the toner was overcharged, which caused a development ghost in a developed image.

(Third Embodiment)

Figure 6:
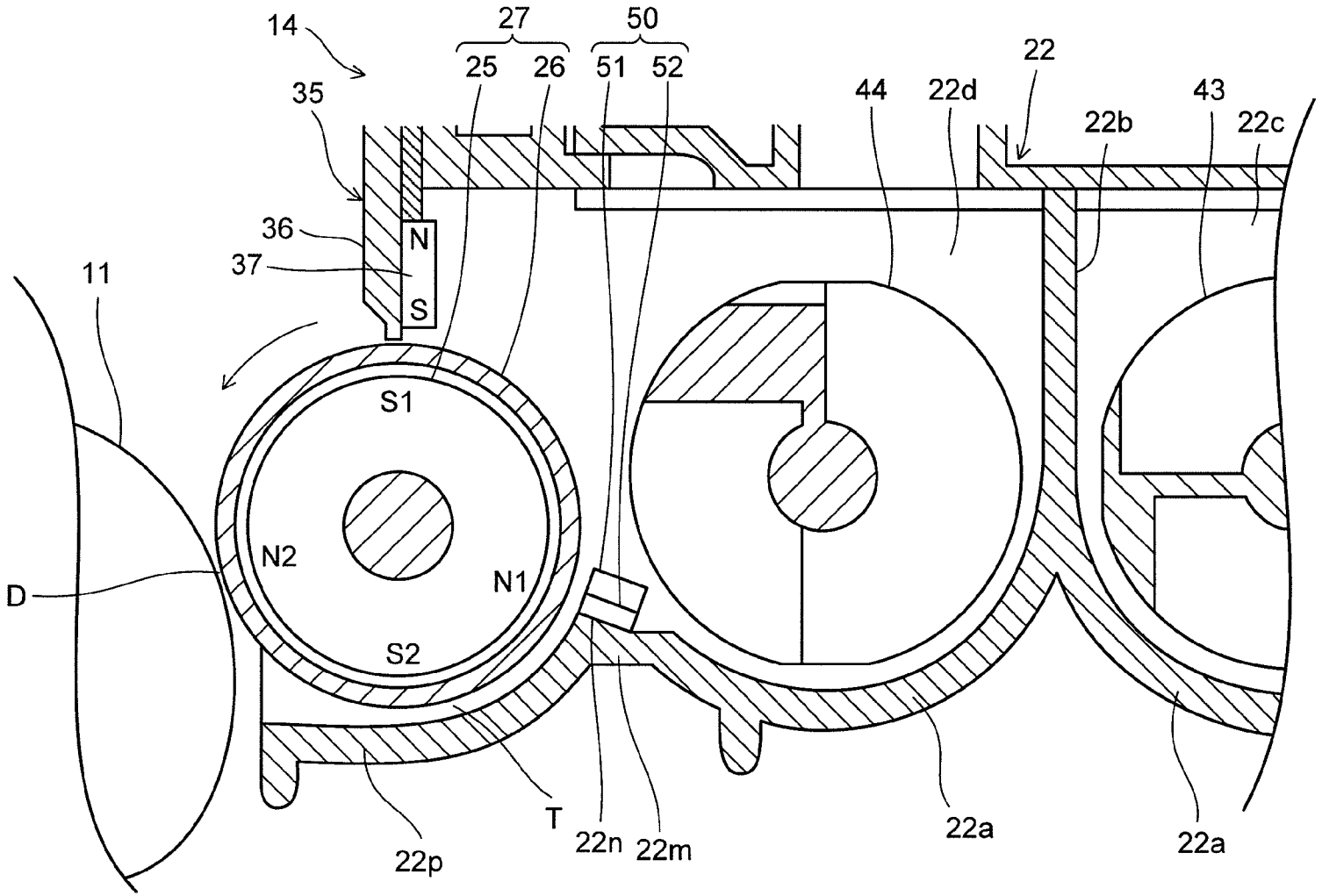
FIG. 6 is a sectional side view of a main-portion structure of the developing device according to a third embodiment of the present invention.
Figure 7:
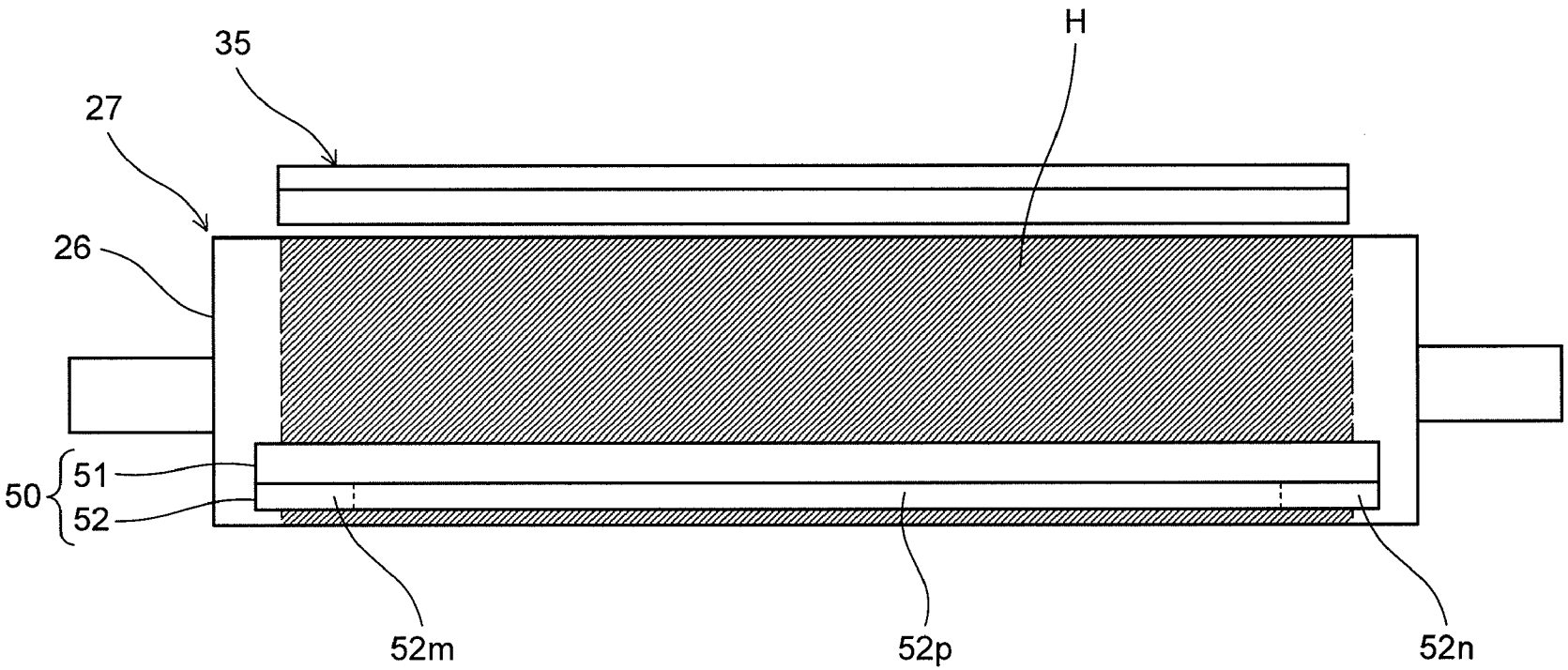
FIG. 7 is a plan view of a magnetic-field generating member and a regulating member of the developing device according to the third embodiment of the present invention.
Figure 8:
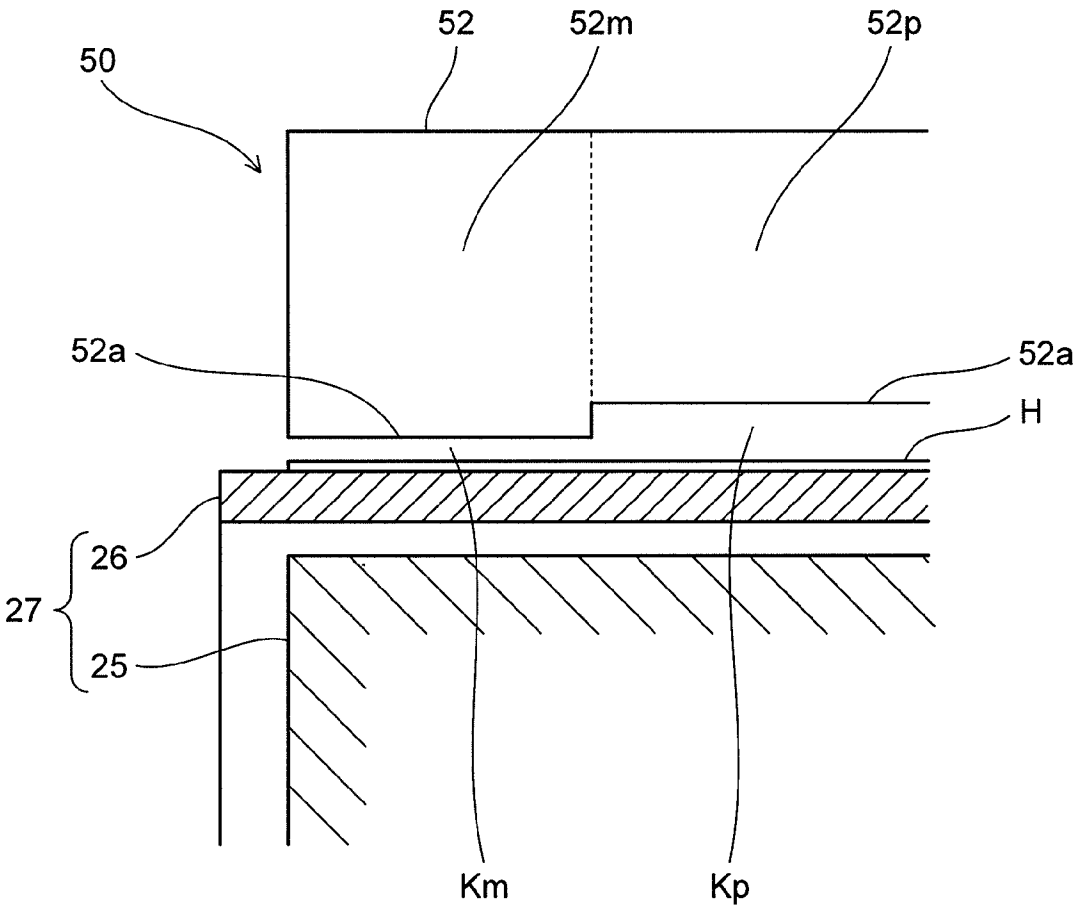
FIG. 8 illustrates one of magnetic-field generating end portions of the magnetic-field generating member of the developing device according to the third embodiment of the present invention.

Next, detailed description is made of the developing device according to a third embodiment with reference to FIGS. 6 to 8. FIG. 6 is a sectional side view of a main-portion structure of the developing device, FIG. 7 is a plan view of the magnetic-field generating member and the regulating member, and FIG. 8 illustrates one end side of a magnetic-field generating end portion of the magnetic-field generating member. Note that, the developing container 22 and the stirring members 43 and 44 have the same structures as those in the first embodiment, and detailed description thereof is omitted.

As illustrated in FIG. 6, in the developer supplying portion 22*p* of the developing container 22, the developing sleeve 26 of the developing roller 27 is rotatably arranged. The developing sleeve 26 is cylindrically made of a non-magnetic material such as aluminum, and is finished to have a surface roughness Rz to 10 μm or less. In the developing sleeve 26, the fixed magnet body 25 is fixedly supported by the developer supplying portion 22*p*. The fixed magnet body 25 has S poles and N poles alternately arranged in the circumferential direction, and generates a magnetic field toward the surface of the developing sleeve 26.

The magnetic pole S1 of the fixed magnet body 25 is arranged at the position facing the regulating member 35. Further, the magnetic pole N2 of the fixed magnet body 25 is arranged at the position facing the developing region D. Still further, the magnetic pole S2 of the fixed magnet body 25 is arranged in the toner circulating region T in which residual toner after development is conveyed. Yet further, the magnetic pole N1 of the fixed magnet body 25 is arranged at the position facing the adjacent portion 22*m*.

The regulating member 35 includes a regulating blade 36 made of a magnetic plate member such as stainless steel, and a plate magnet 37 which is a permanent magnet.

The regulating blade 36 is attached to the developing container 22 substantially above the developing sleeve 26 at a predetermined interval with respect to the surface of the developing sleeve 26. The regulating blade 36 has the distal end portion having an edge shape and facing the surface of the developing sleeve 26.

The plate magnet 37 is attached to the regulating blade 36 on the upstream in the rotational direction of the developing roller. A distal end portion of the plate magnet 37, which faces the developing sleeve 26, is apart from the developing sleeve 26 farther than the distal end portion of the regulating blade 36. The distal end portion of the plate magnet 37 has an S pole which is the same as that of the magnetic pole S1 of the fixed magnet body 25 in the developing sleeve 26, and an N pole on an opposite end.

With this structure, by a magnetic force of the plate magnet 37, the distal end portion of the regulating blade 36 is magnetized in reverse polarity (N pole) to that of the distal end portion of the plate magnet 37. Accordingly, between the distal end portion of the regulating blade 36 and the developing sleeve 26, a magnetic field is formed by the magnetic pole N1 of the fixed magnet body 25 and the plate magnet 37. Further, a magnetic field is formed also between the distal end portion of the regulating blade 36 and the plate magnet 37. Those magnetic fields cause toner to pass between the distal end portion of the regulating blade 36 and the developing sleeve 26 in a substantially uniform state, and a toner thin layer is formed on the developing sleeve 26. As a result, as illustrated in FIG. 7, in a longitudinal direction of the developing sleeve 26 (lateral direction of FIG. 7), a toner layer is formed in a developer layer region H corresponding to a width of the regulating member 35 (length in the lateral direction). Note that, description is made later of magnetic-field generating end portions 52*m* and 52*n* and a magnetic-field generating central portion 52*p* of the magnetic-field generating member 50 illustrated in FIG. 7.

Referring back to FIG. 6, the magnetic-field generating member 50 faces the surface of the developing sleeve 26 at a fixed interval when being attached to the attachment portion 22*n* of the developing container 22. Then, the magnetic-field generating member 50 faces the magnetic pole N1 of the fixed magnet body 25 through intermediation of the developing sleeve 26, and generates a magnetic field between the magnetic-field generating member 50 and the magnetic pole N1 of the fixed magnet body 25.

Similarly to the first embodiment (refer to FIG. 4), the magnetic-field generating member 50 includes the magnet 51 and the magnetic body 52.

As illustrated in FIG. 4, the magnet 51 of the magnetic-field generating member 50 is a permanent magnet, and faces the surface of the developing sleeve 26 at a fixed interval. Further, the magnet 51 includes the facing magnetic pole 51*a* facing the magnetic pole N1 (N pole) of the fixed magnet body 25 through intermediation of the developing sleeve 26, and the opposite magnetic pole 51*b* positioned on the opposite side to the facing magnetic pole 51*a* in the normal direction of the developing sleeve 26. The facing magnetic pole 51*a* has the same polarity (N pole) as that of the magnetic pole N1 of the fixed magnet body 25, and the opposite magnetic pole 51*b* is an S pole. Further, the magnet 51 has a rectangular shape in cross-section, and includes the facing portion 51*c* positioned on the upstream in the rotational direction of the developing roller.

The magnetic body 52 is made of a magnetic material such as stainless steel, and firmly attached by adhesive to the facing portion 51*c* of the magnet 51. Further, the magnetic body 52 includes the distal end portion 52*a* and the opposite facing portion 52*b*. The distal end portion 52*a* faces the surface of the developing sleeve 26 at an interval substantially equal to that between the facing magnetic pole 51*a* of the magnet 51 and the surface of the developing sleeve 26. The interval is set to be smaller than the interval between the surface of the developing sleeve 26 and the regulating member 35 (refer to FIG. 6). The opposite facing portion 52*b* is positioned on the opposite side to the distal end portion 52*a* in the normal direction of the developing sleeve 26, and formed to be flush with the flat surface of the opposite magnetic pole 51*b* of the magnet 51. Note that, in this embodiment, although the magnetic body 52 is attached on the upstream of the magnet 51 in the rotational direction of the developing roller, this should not be construed restrictively. The magnetic body 52 may be attached on the downstream of the magnet 51 in the rotational direction of the developing roller.

With this structure, the distal end portion 52*a* of the magnetic body 52 is magnetized to have an S pole, and the opposite facing portion 52*b* is magnetized to have an N pole. Accordingly, the magnetic body 52 forms a magnetic path constituted by magnetic lines of force between the magnetic body 52 and the magnet 51, and the magnetic body 52 forms a magnetic path constituted by magnetic lines of force between the magnetic body 52 and the fixed magnet body 25.

In other words, the opposite facing portion 52*b* of the magnetic body 52 is magnetized to have an N pole. Thus, there are formed magnetic lines of force passing between the opposite facing portion 52*b* of the magnetic body 52 and the opposite magnetic pole (S pole) 51*b* of the magnet 51, and there are formed magnetic lines of force passing between the opposite facing portion 52*b* of the magnetic body 52 and the magnetic pole (S pole) adjacent to the magnetic pole N1 of the fixed magnet body 25.

Further, in the circumferential direction of the developing roller, the opposite facing portion 52*b* of the magnetic body 52 is formed to have the width larger than the width of the distal end portion 52*a* of the magnetic body 52. With this, a large number of magnetic lines of force are formed between the opposite facing portion 52*b* of the magnetic body 52 and the opposite magnetic pole (S pole) 51*b* of the magnet 51, and a large number of magnetic lines of force are formed between the opposite facing portion 52*b* of the magnetic body 52 and one of the magnetic poles (S poles) of the fixed magnet body 25.

Still further, the distal end portion 52*a* of the magnetic body 52 is magnetized to have an S pole, and has a relatively small width. Thus, there are intensively formed magnetic lines of force passing between the distal end portion 52*a* and the facing magnetic pole (N pole) 51*a* of the magnet 51, and there are intensively formed magnetic lines of force passing between the distal end portion 52*a* and the magnetic pole N1 of the fixed magnet body 25. In this way, the two magnetic paths each constituted by the magnetic lines of force are formed in the narrow region between the distal end portion 52*a* of the magnetic body 52 and the surface of the developing sleeve 26, with the result that density of the magnetic lines of force increases. Magnetic fields corresponding to the magnetic lines of force are generated at the distal end portion 52*a* of the magnetic body 52 and on the surface of the developing sleeve 26.

Further, as illustrated in FIG. 8, the magnetic body 52 of the magnetic-field generating member 50 includes the magnetic-field generating end portion 52*m* and the magnetic-field generating central portion 52*p*. The magnetic-field generating end portion 52*m* faces an end portion in the longitudinal direction of the developer layer region H formed on the developing sleeve 26, and the magnetic-field generating central portion 52*p* is positioned while facing a central portion in the longitudinal direction of the developer layer region H. The magnetic-field generating end portion 52*m* and the magnetic-field generating central portion 52*p* have intervals different from each other with respect to the surface of the developing sleeve 26. Note that, FIG. 8 illustrates the one end side (magnetic-field generating end portion 52*m*) of the magnetic-field generating member 50, and the other end side (magnetic-field generating end portion 52*n*, refer to FIG. 7) has the same structure and functions.

In other words, an end-portion-side interval Km between the distal end portion 52*a* of the magnetic-field generating end portion 52*m* of the magnetic body 52 and the surface of the developing sleeve 26 is set to be relatively small. Meanwhile, a central-side interval Kp between the distal end portion 52*a* of the magnetic-field generating central portion 52*p* of the magnetic body 52 and the surface of the developing sleeve 26 is set to be relatively large. Specifically, the end-portion-side interval Km is set to 0.3 mm, and the central-side interval Kp is set to 0.5 mm. Note that, although not shown, the magnet 51 is shaped to have an interval equal to that of the magnetic body 52 with respect to the surface of the developing sleeve 26.

Accordingly, in accordance with the end-portion-side interval Km and the central-side interval Kp, the magnetic flux density between the distal end portion 52*a* of the magnetic-field generating central portion 52*p* and the surface of the developing sleeve 26 is different from the magnetic flux density between the distal end portion 52*a* of the magnetic-field generating end portion 52*m* and the surface of the developing sleeve 26. The end-portion-side interval Km is smaller than the central-side interval Kp, and hence the magnetic flux density between the distal end portion 52*a* of the magnetic-field generating member 50 and the surface of the developing sleeve 26 is larger on a magnetic-field generating end portion 52*m* side than on a magnetic-field generating central portion 52*p* side.

In this way, in accordance with magnitudes of the magnetic fields on the end portion sides and the central portion in the longitudinal direction of the developer layer region H, toner is scraped off from the surface of the developing sleeve 26.

As illustrated in FIG. 6, around the developing sleeve 26, the regulating member 35, the developing region D, the toner circulating region T, and the magnetic-field generating member 50 are arranged in the stated order along the rotational direction (arrow direction) of the developing sleeve 26.

Normally, the magnetic force of the fixed magnet body 25 in the developing roller 27 is lower on the end portion side than on the central portion side. Further, the magnetic force of the plate magnet 37 of the regulating member 35 is lower on the end portion side than on the central portion side. Thus, a toner charging amount increases on the end portion sides, and hence toner strongly adheres to the surface of the developing sleeve 26. After repetitive development, even when the toner has a predetermined layer thickness on the central portion in the longitudinal direction at the time of passing between the regulating member 35 and the developing sleeve 26, the toner layer thickness is larger on the end portion sides. As a result, disturbance of the toner layer occurs.

Although residual toner is left on the developing sleeve 26 even after development in a state in which the toner layer is disturbed, a relatively large magnetic field formed by the magnetic-field generating end portions 52*m* and 52*n* of the magnetic-field generating member 50 and the magnetic pole N1 of the fixed magnet body 25 causes the residual toner on both-end-portion sides to be scraped off by a large amount from the surface of the developing sleeve 26. Meanwhile, a relatively small magnetic field formed by the magnetic-field generating central portion 52*p* of the magnetic-field generating member 50 and the magnetic pole N1 of the fixed magnet body 25 causes the residual toner on the central portion side to be scraped off by a small amount from the surface of the developing sleeve 26. As a result, new toner is carried on the developing sleeve 26 under a state in which there is no disturbance of the toner layer on the developing sleeve 26.

(Fourth Embodiment)

Figure 9:
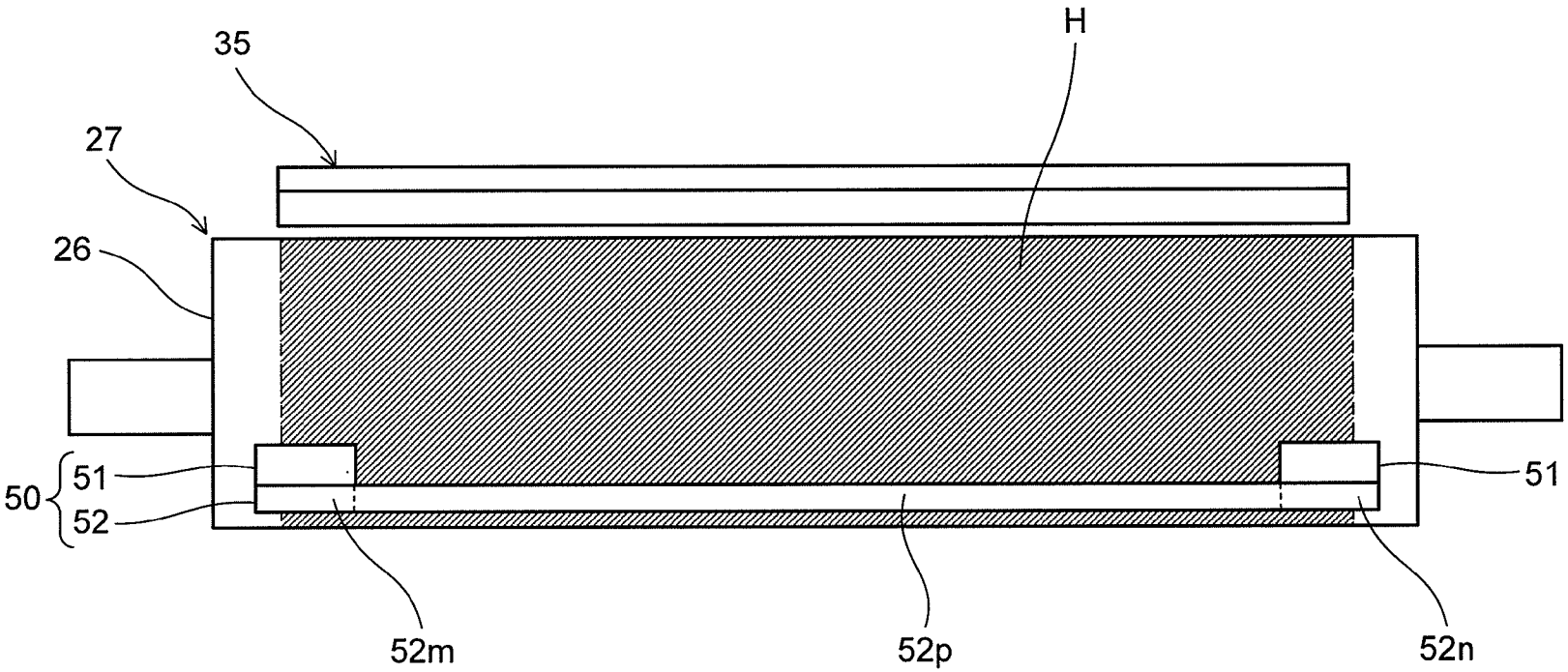
FIG. 9 is a plan view of a magnetic-field generating member and a regulating member of a developing device according to a fourth embodiment of the present invention.

Next, description is made of a modification of the magnetic-field generating member with reference to FIG. 9. FIG. 9 is a plan view of the magnetic-field generating member and the regulating member. In a fourth embodiment, the magnets 51 of the magnetic-field generating member 50 are different from that in the third embodiment.

Similarly to the third embodiment, the magnetic body 52 of the magnetic-field generating member 50 is made of a magnetic material such as a stainless plate, and extends to both the end portions in the longitudinal direction of the developer layer region H. Further, the end-portion-side interval Km between the distal end portion 52*a* (refer to FIG. 8) of each of the magnetic-field generating end portions 52*m* and 52*n* of the magnetic body 52 and the surface of the developing sleeve 26 is set to be relatively small. Meanwhile, the central-side interval Kp between the distal end portion 52*a* of the magnetic-field generating central portion 52*p* and the surface of the developing sleeve 26 is set to be relatively large. Specifically, the end-portion-side interval Km is set to 0.3 mm, and the central-side interval Kp is set to 0.5 mm.

The magnets 51 are permanent magnets, and face the surface of the developing sleeve 26 at a fixed interval while having the same polarity as that of the magnetic pole N1 of the fixed magnet body 25 (refer to FIG. 4). Further, the magnets 51 are arranged only on the both-end-portion sides of the developer layer region H. In other words, the magnets 51 are arranged in ranges corresponding to the magnetic-field generating end portions 52*m* and 52*n* in the third embodiment. Still further, the magnets 51 are firmly attached by adhesive to a downstream surface of the magnetic body 52 in the rotational direction of the developing roller. Note that, the magnets 51 may be attached to an upstream surface of the magnetic body 52 in the rotational direction of the developing roller.

Accordingly, similarly to the third embodiment, on the end-portion sides of the developer layer region H, the distal end portion 52*a* (refer to FIG. 4) of each of the magnetic-field generating end portions 52*m* and 52*n* of the magnetic body 52 is magnetized by the magnets 51. Thus, there are formed magnetic lines of force passing between the distal end portion 52*a* of the magnetic body 52 and the facing magnetic pole 51*a* of each of the magnets 51 (refer to FIG. 4). Further, there are formed magnetic lines of force passing between the distal end portion 52*a* of each of the magnetic-field generating end portions 52*m* and 52*n* of the magnetic body 52 and the fixed magnet body 25. Magnetic fields corresponding to the magnetic lines of force are formed at the distal end portion 52*a* of each of the magnetic-field generating end portions 52*m* and 52*n* of the magnetic body 52 and on the surface of the developing sleeve 26.

Meanwhile, on the central portion side of the developer layer region H, the distal end portion 52*a* (refer to FIG. 4) of the magnetic-field generating central portion 52*p* of the magnetic body 52 is magnetized to have an opposite magnetic pole to that of the magnetic pole N1 (refer to FIG. 4) of the fixed magnet body 25. As a result, there are formed magnetic lines of force passing between the distal end portion 52*a* of the magnetic-field generating central portion 52*p* of the magnetic body 52 and the magnetic pole N1 of the fixed magnet body 25. A magnetic field corresponding to the magnetic lines of force is formed at the distal end portion 52*a* of the magnetic-field generating central portion 52*p* of the magnetic body 52 and on the surface of the developing sleeve 26.

Further, the end-portion-side interval Km and the central-side interval Kp which are between the magnetic-field generating member 50 and the surface of the developing sleeve 26 are different from each other. In accordance with the end-portion-side interval Km and the central-side interval Kp, the magnetic flux density between the distal end portion 52*a* of the magnetic-field generating central portion 52*p* and the surface of the developing sleeve 26 is different from the magnetic flux density between the distal end portion 52*a* of the magnetic-field generating end portion 52*m* and the surface of the developing sleeve 26. The end-portion-side interval Km is smaller than the central-side interval Kp, and hence the magnetic flux density between the distal end portion 52*a* of the magnetic-field generating member 50 and the surface of the developing sleeve 26 is larger on the magnetic-field generating end portion 52*m* side than on the magnetic-field generating central portion 52*p* side.

In this way, in accordance with the magnitudes of the magnetic fields on the end portion sides and the central portion in the longitudinal direction of the developer layer region H, residual toner after development on the surface of the developing sleeve 26 is scraped off. As a result, new toner is carried on the developing sleeve 26 under the state in which there is no disturbance of the toner layer on the developing sleeve 26.

(Fifth Embodiment)

Figure 10:
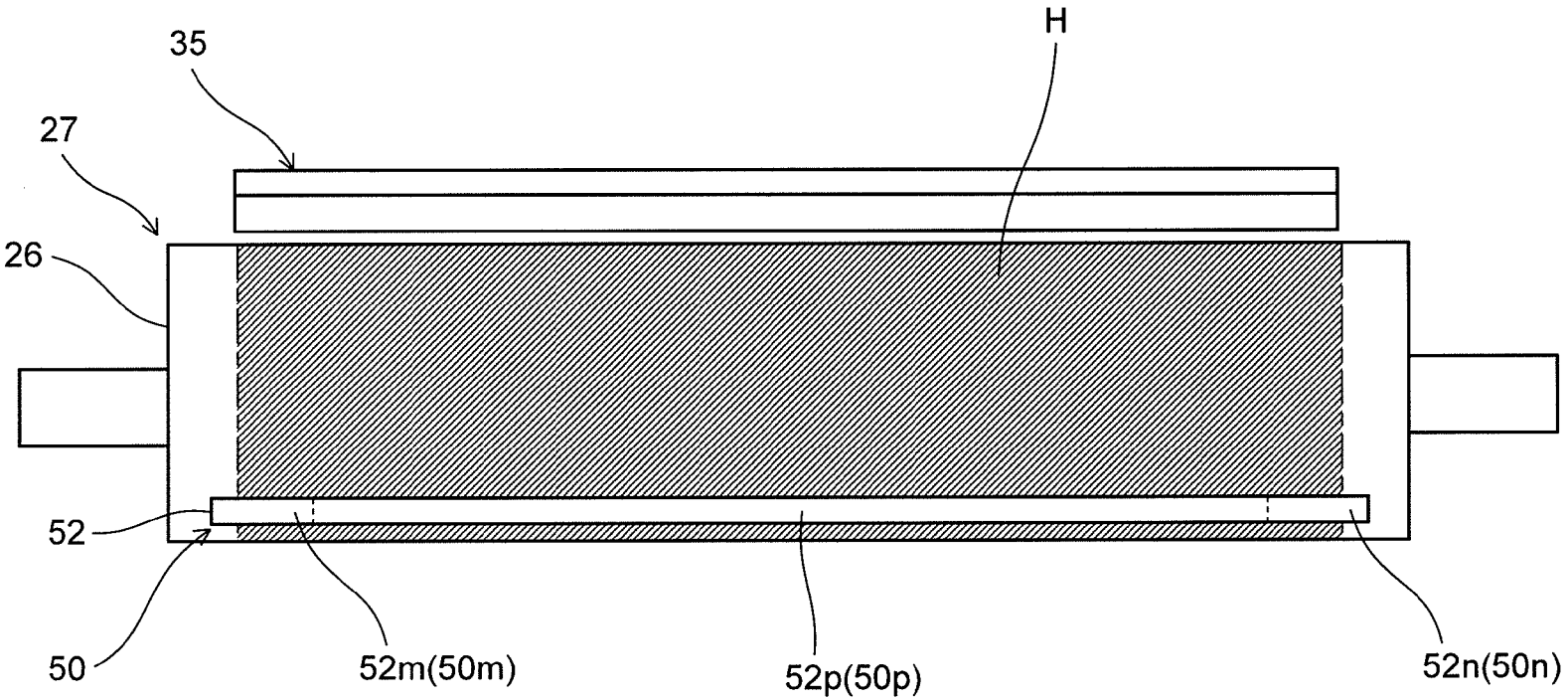
FIG. 10 is a plan view of a magnetic-field generating member and a regulating member of a developing device according to a fifth embodiment of the present invention.

Next, description is made of a modification of the magnetic-field generating member 50 with reference to FIG. 10. FIG. 10 is a plan view of the magnetic-field generating member and the regulating member. The magnetic-field generating member 50 in a fifth embodiment is different from those in the third and fourth embodiments in that the magnetic-field generating member 50 includes the magnetic body 52 without use of the magnet 51.

As illustrated in FIG. 10, the magnetic-field generating member 50 includes the magnetic body 52 made of a magnetic material such as a stainless plate, and extends to both the end portions in the longitudinal direction of the developer layer region H. Further, the end-portion-side interval Km between the distal end portion 52*a* (refer to FIG. 8) of each of the magnetic-field generating end portions 52*m* and 52*n* of the magnetic body 52 and the surface of the developing sleeve 26 is set to be relatively small. Meanwhile, the central-side interval Kp between the distal end portion 52*a* of the magnetic-field generating central portion 52*p* and the surface of the developing sleeve 26 is set to be relatively large. Specifically, the end-portion-side interval Km is set to 0.3 mm, and the central-side interval Kp is set to 0.5 mm.

Accordingly, the distal end portion 52*a* of the magnetic body 52 is magnetized to have an opposite magnetic pole to that of the magnetic pole N1 of the fixed magnet body 25. As a result, there are formed magnetic lines of force passing between the distal end portion 52*a* of the magnetic-field generating central portion 52*p* of the magnetic body 52 and the magnetic pole N1 of the fixed magnet body 25. A magnetic field corresponding to the magnetic lines of force is formed at the distal end portion 52*a* of the magnetic-field generating central portion 52*p* of the magnetic body 52 and on the surface of the developing sleeve 26.

Further, the end-portion-side interval Km and the central-side interval Kp which are between the magnetic-field generating member 50 and the surface of the developing sleeve 26 are different from each other. In accordance with the end-portion-side interval Km and the central-side interval Kp, the magnetic flux density between the distal end portion 52*a* of the magnetic-field generating central portion 52*p* and the surface of the developing sleeve 26 is different from the magnetic flux density between the distal end portion 52*a* of the magnetic-field generating end portion 52*m* and the surface of the developing sleeve 26. The end-portion-side interval Km is smaller than the central-side interval Kp, and hence the magnetic flux density between the distal end portion 52*a* of the magnetic-field generating member 50 and the surface of the developing sleeve 26 is larger on the magnetic-field generating end portion 52*m* side than on the magnetic-field generating central portion 52*p* side.

In this way, in accordance with the magnitudes of the magnetic fields on the end portion sides and the central portion in the longitudinal direction of the developer layer region H, residual toner after development on the surface of the developing sleeve 26 is scraped off. As a result, new toner is carried on the developing sleeve 26 under the state in which there is no disturbance of the toner layer on the developing sleeve 26.

(Sixth Embodiment)

Figure 11:
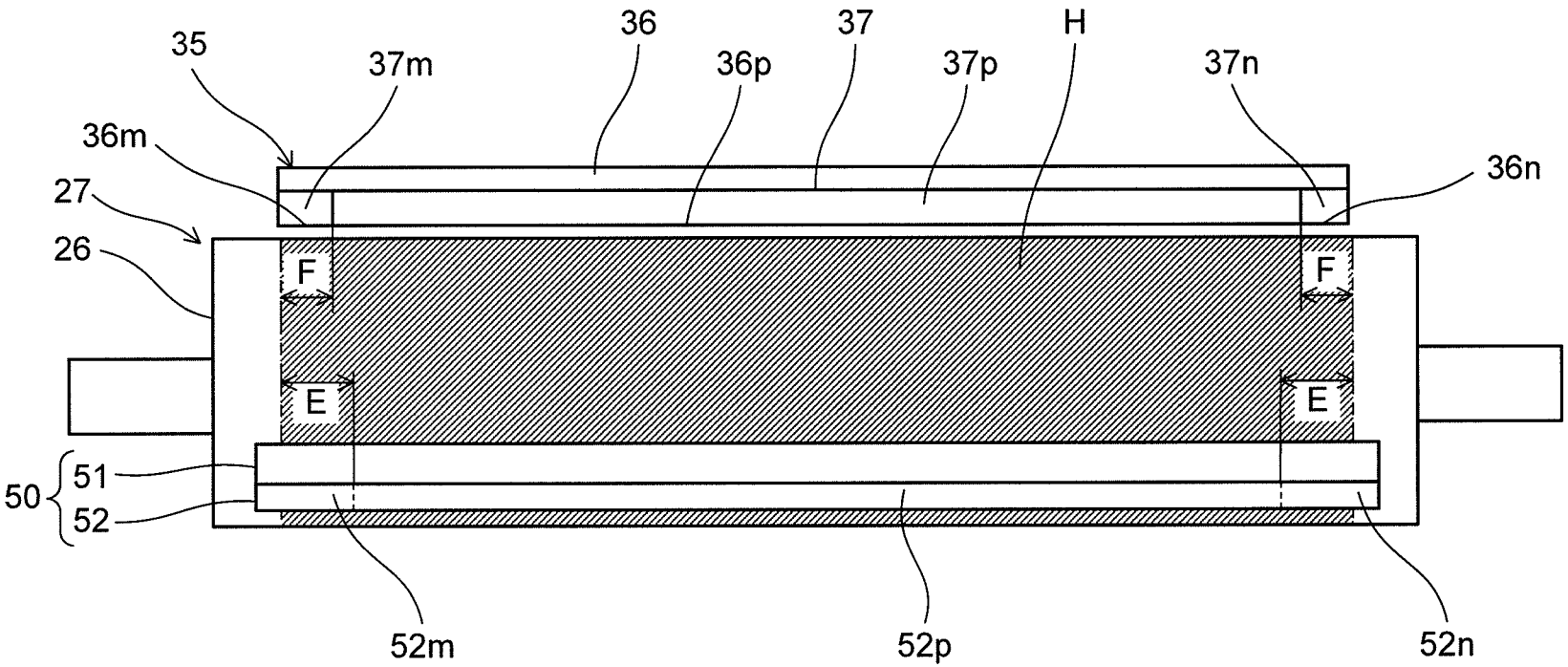
FIG. 11 is a plan view of a magnetic-field generating member and a regulating member of a developing device according to a sixth embodiment of the present invention.

FIG. 11 is a plan view of the magnetic-field generating member and the regulating member according to a sixth embodiment. In the sixth embodiment, the magnetic-field generating member 50 is constituted correspondingly to the regulating member 35 having higher magnetic forces on the end portion sides.

As described above, the magnetic forces on the end portions in the longitudinal direction of the fixed magnet body 25 in the developing roller 27 and the plate magnet 37 of the regulating member 35 are lower than those on the central portion side thereof, and hence disturbance of the toner layer is liable to occur. In order to prevent the disturbance, as illustrated in FIG. 11, magnetic forces of plate-magnet end portions 37*m* and 37*n* formed on the end portion sides of the plate magnet 37 are set to be higher than magnetic force of a plate-magnet central portion 37*p* formed on the central portion side thereof.

However, at the time of setting of the magnetic forces of the plate-magnet end portions 37*m* and 37*n* and the plate-magnet central portion 37*p*, when the magnetic forces of the plate-magnet end portions 37*m* and 37*n* are excessively high, magnetic forces of end-portion regulating portions 36*m* and 36*n* of the regulating blade 36 are also excessively higher than magnetic force of a central regulating portion 36*p* in accordance therewith. As a result, a height difference is formed between a toner layer on each of the end portion sides and a toner layer on the central portion side in the developer layer region H.

In this context, although the magnetic-field generating member 50 in this embodiment includes the magnetic body 52 and the magnet 51 similarly to those in the third embodiment, a distance E in the longitudinal direction of each of the magnetic-field generating end portions 52*m* and 52*n* of the magnetic body 52 is set to be longer than a distance F in the longitudinal direction of each of the end-portion regulating portions 36*m* and 36*n* of the regulating member 35. Note that, both the distances E and F are length from the end portions of the developer layer region H.

As a result of setting of the distances E and F as just described above, the magnetic-field generating end portions 52*m* and 52*n* of the magnetic body 52 are provided so as to face the developer layer region H while including a part of the developer layer region H, the part corresponding to a boundary between each of the end-portion regulating portions 36*m* and 36*n* and the central regulating portion 36*p* of the regulating member 35. In addition, each of the distal end portions 52*a* (refer to FIG. 4) of the magnetic-field generating end portions 52*m* and 52*n* of the magnetic body 52 has a magnetic force higher than a magnetic force of the distal end portion 52*a* of the magnetic-field generating central portion 52*p*. With this, when scraping off residual toner after development on the surface of the developing sleeve 26, the magnetic-field generating member 50 scrapes off the residual toner in a manner of eliminating the height difference of the toner layer, which is generated on the boundary part between each of the end-portion regulating portions 36*m* and 36*n* and the central regulating portion 36*p* of the regulating member 35.

Note that, in order to eliminate the height difference of the toner layer, the magnetic-field generating member in the fourth embodiment (refer to FIG. 9) may be employed. In this case, the two magnets 51 are attached so that one ends thereof are arranged at the distance E, and arranged so as to face the developer layer region H while including a part of the developer layer region H, the part corresponding to the boundary between each of the end-portion regulating portions 36*m* and 36*n* and the central regulating portion 36*p* of the regulating member 35. Alternatively, the magnetic-field generating member in the fifth embodiment (refer to FIG. 10) may be employed. In this case, the magnetic-field generating end portions 52*m* and 52*n* of the magnetic body 52 are arranged so as to face the developer layer region H while including the part of the developer layer region H, the part corresponding to the boundary between each of the end-portion regulating portions 36*m* and 36*n* and the central regulating portion 36*p* of the regulating member 35.

According to the third to sixth embodiments, the developing device 14 includes the following: the developing roller 27 incorporating the fixed magnet body 25 having the plurality of magnetic poles in the circumferential direction, for supplying toner to the developing region D facing the photosensitive member 11; the regulating member 35 for regulating an amount of the toner on the developing roller 27 so as to form the developer layer region H by means of the magnetic field formed also by the magnetic pole S1 of the fixed magnet body 25, the magnetic pole S1 facing the developing roller 27; and the magnetic-field generating member 50 for scraping off, on the upstream of the regulating member 35 in the rotational direction of the developing roller, toner which is not used for development on the developing roller 27. The magnetic-field generating member 50 includes the magnetic-field generating end portions 52*m* and 52*n* respectively facing the both-end-portions in the longitudinal direction of the developer layer region H, and the magnetic-field generating central portion 52*p* sandwiched in the longitudinal direction between the magnetic-field generating end portions 52*m* and 52*n*. The interval Km between the magnetic-field generating end portion 52*m* and the surface of the developing roller 27 is smaller than the interval Kp between the magnetic-field generating central portion 52*p* and the surface of the developing roller 27.

With this structure, even when a toner layer thickness in the developer layer region H is larger on the end portions than on the central portion in the longitudinal direction, and residual toner is left on the surface of the developing roller 27 after development, the residual toner on the central portion side and the end portion sides is scraped off by magnetic fields in accordance respectively with sizes of the intervals Km and Kp between the magnetic-field generating member 50 and the surface of the developing roller 27. In other words, a magnetic flux density is relatively small on the central portion side in the developer layer region H, and another magnetic flux density is relatively large on the end portion sides. Thus, toner is reliably scraped off in accordance with magnitudes of magnetic flux densities, and hence there is no disturbance of the toner layer on the developing roller 27. As a result, satisfactory images can be obtained.

Further, according to the third, fourth, and sixth embodiments, the magnetic-field generating member 50 includes the magnetic body 52 facing the surface of the developing roller 27 at the predetermined interval, and the magnet 51 which includes the facing magnetic pole 51*a* facing the surface of the developing roller 27 and which is attached to the magnetic body 52 while facing the magnetic body 52 in the rotational direction of the developing roller. The facing magnetic pole 51*a* of the magnet 51 has the same polarity as that of the magnetic pole N1 of the fixed magnet body 25, and the interval Km between the magnetic-field generating end portion 52*m* of the magnetic body 52 and the surface of the developing roller 27 is smaller than the interval Kp between the magnetic-field generating central portion 52*p* of the magnetic body 52 and the developing roller 27.

With this, the distal end portion 52*a* of the magnetic body 52 is magnetized to have the opposite magnetic pole to that of the facing magnetic pole 51*a* of the magnet 51, and the magnetic lines of force are formed, which pass between the distal end portion 52*a* of the magnetic body 52 and the facing magnetic pole 51*a* of the magnet 51. Further, the magnetized magnetic pole of the distal end portion 52*a* of the magnetic body 52 has an opposite polarity also to that of the magnetic pole N1 of the fixed magnet body 25, and the magnetic lines of force are formed which pass between the distal end portion 52*a* of the magnetic body 52 and the fixed magnet body 25. In this way, the two magnetic paths each constituted by the magnetic lines of force are formed between the distal end portion 52*a* of the magnetic body 52 and the surface of the developing roller 27. As a result, density of the magnetic lines of force increases. The magnetic fields corresponding to the magnetic lines of force have the magnetic flux densities in accordance respectively with the sizes of the intervals Km and Kp between the distal end portion 52*a* of the magnetic body 52 and the surface of the developing roller 27. Specifically, the magnetic flux density is relatively small on the central portion side in the developer layer region H, and the another magnetic flux density is relatively large in the developer layer region H. Thus, residual toner after development on the surface of the developing roller 27 is scraped off in accordance with the magnitudes of the magnetic flux densities.

Accordingly, even when the toner layer thickness in the developer layer region H is larger on the end portion than on the central portion in the longitudinal direction, and residual toner is left on the surface of the developing roller 27 after development, the residual toner is reliably scraped off. Thus, there is no disturbance of the toner layer on the developing roller 27. As a result, satisfactory images can be obtained.

Further, according to the fourth embodiment, the magnetic-field generating member 50 includes the magnetic body 52 facing the surface of the developing roller 27 at the predetermined interval, and the magnet 51 which includes the facing magnetic pole 51*a* facing the surface of the developing roller 27 and which is attached to the magnetic body 52 while facing the magnetic body 52 in the rotational direction of the developing roller. The magnetic body 52 extends to the both-end-portions in the longitudinal direction of the developer layer region H. The pair of magnets 51 are arranged on the both-end-portions, so as to face each other, in the longitudinal direction of the developer layer region H. The facing magnetic pole 51*a* of each of the pair of magnets 51 has the same polarity as that of the magnetic pole N1 of the fixed magnet body 25. The interval Km between the magnetic-field generating end portion 52*m* of the magnetic body 52 and the surface of the developing roller 27 is smaller than the interval Kp between the magnetic-field generating central portion 52*p* of the magnetic body 52 and the surface of the developing roller 27.

With this, on the end-portion sides of the developer layer region H, the distal end portion 52*a* of the magnetic body 52 is magnetized to have the opposite magnetic pole to that of the facing magnetic pole 51*a* of the magnet 51, and the magnetic lines of force are formed, which pass between the distal end portion 52*a* of the magnetic body 52 and the facing magnetic pole 51*a* of the magnet 51. Further, the magnetized magnetic pole of the distal end portion 52*a* of the magnetic body 52 has an opposite polarity also to that of the magnetic pole N1 of the fixed magnet body 25, and the magnetic lines of force are formed, which pass between the distal end portion 52*a* of the magnetic body 52 and the fixed magnet body 25. The magnetic fields corresponding to those two magnetic paths each constituted by the magnetic lines of force are formed at the distal end portion 52*a* of the magnetic body 52 and on the surface of the developing roller 27. Meanwhile, on the central portion side in the developer layer region H, the distal end portion 52*a* of the magnetic body 52 is magnetized to have the opposite magnetic pole to that of the magnetic pole N1 of the fixed magnet body 25, and the magnetic fields of the distal end portion 52*a* of the magnetic body 52 and the magnetic pole N1 of the fixed magnet body 25 are formed at the distal end portion 52*a* of the magnetic body 52 and on the surface of the developing roller 27. With this, the magnetic field on the end portion sides and the central portion side in the developer layer region H is relatively small on the central portion side and relatively large on the end portion sides. Further, the magnetic flux densities are obtained in accordance respectively with the sizes of the intervals Km and Kp between the distal end portion 52*a* of the magnetic body 52 and the surface of the developing roller 27. Specifically, the magnetic flux density is relatively small on the central portion side in the developer layer region H, and the another magnetic flux density is relatively large on the end portion sides in the developer layer region H. Thus, residual toner after development on the surface of the developing roller 27 is scraped off in accordance with the magnitudes of the magnetic flux densities just described above.

Accordingly, even when the toner layer thickness in the developer layer region H is larger on the end portions than on the central portion in the longitudinal direction, and residual toner is left on the surface of the developing roller 27 after development, the residual toner is reliably scraped off. Thus, there is no disturbance of the toner layer on the developing roller 27. As a result, satisfactory images can be obtained.

Further, according to the fifth embodiment, the magnetic-field generating member 50 includes the magnetic body 52 facing the surface of the developing roller 27 at the predetermined interval. The magnetic body 52 faces the magnetic pole N1 of the fixed magnet body 25. The interval Km between the magnetic-field generating end portion 52*m* of the magnetic body 52 and the surface of the developing roller 27 is smaller than the interval Kp between the magnetic-field generating central portion 52*p* of the magnetic body 52 and the surface of the developing roller 27.

With this, the distal end portion 52*a* of the magnetic body 52 is magnetized to have the opposite magnetic pole to that of the magnetic pole N1 of the fixed magnet body 25, and the magnetic fields of the distal end portion 52*a* of the magnetic body 52 and the magnetic pole N1 of the fixed magnet body 25 are formed at the distal end portion 52*a* of the magnetic body 52 and on the surface of the developing roller 27. The magnetic fields have the magnitude in accordance respectively with the sizes of the intervals Km and Kp between the distal end portion 52*a* of the magnetic body 52 and the surface of the developing roller 27. Specifically, the magnetic field on the central portion side is relatively small on the central portion side in the developer layer region H, and the another magnetic fields on the end portion sides are relatively large in the developer layer region H. Thus, residual toner after development on the surface of the developing roller 27 is scraped off in accordance with the respective magnetic field.

Accordingly, even when the toner layer thickness in the developer layer region H is larger on the end portions than on the central portion in the longitudinal direction, and residual toner is left on the surface of the developing roller 27 after development, the residual toner is reliably scraped off. Thus, there is no disturbance of the toner layer on the developing roller 27. As a result, satisfactory images can be obtained.

Further, according to the sixth embodiment, the regulating member 35 includes the end-portion regulating portions 36*m* and 36*n* facing the both-end-portions in the longitudinal direction of the developer layer region H, and the central regulating portion 36*p* sandwiched in the longitudinal direction between the end-portion regulating portions 36*m* and 36*n*. The end-portion regulating portion 36*m* has a magnetic force higher than a magnetic force of the central regulating portion 36*p*. The magnetic-field generating end portion 52*m* of the magnetic-field generating member 50 is formed so as to face the developer layer region H while including a part of the developer layer region H, the part corresponding to the boundary between the end-portion regulating portion 36*m* and the central regulating portion 36*p*.

At the time of formation of the developer layer region H with use of the regulating member 35, when the magnetic force of the end-portion regulating portion 36*m* is higher than the magnetic force of the central regulating portion 36*p*, a height difference is formed between the toner layer on each of the end portion sides and the toner layer on the central portion side of the developer layer region H. However, the magnetic-field generating end portion 52*m* of the magnetic-field generating member 50 is provided so as to face the developer layer region H while including the part of the developer layer region H, the part corresponding to the boundary between the end-portion regulating portion 36*m* and the central regulating portion 36*p* of the regulating member 35. Thus, when scraping off residual toner after development on the surface of the developing roller 27, the magnetic-field generating member 50 scrapes off the residual toner in a manner of eliminating the height difference of the toner layer. Thus, there is no disturbance of the toner layer on the developing roller 27. As a result, satisfactory images can be obtained.

Note that, in the third to sixth embodiments, as illustrated in FIG. 8, although the boundary portion between the magnetic-field generating end portion 52*m* and the magnetic-field generating central portion 52*p* of the magnetic body 52 is perpendicularly formed, the present invention is not limited thereto. For example, the boundary portion between the magnetic-field generating end portion 52*m* and the magnetic-field generating central portion 52*p* may be formed in an inclined manner so that the interval with respect to the developing sleeve 26 gradually changes from the magnetic-field generating end portion 52*m* to the magnetic-field generating central portion 52*p*. In this case, although the magnetic flux density between the magnetic-field generating member 50 and the surface of the developing sleeve 26 gradually changes in the boundary portion, the same advantages as those in the above-mentioned embodiments are obtained.

Further, in the magnetic-field generating member 50, when the interval Km on the magnetic-field generating end portion 52*m* side is smaller than the interval Kp on the magnetic-field generating central portion 52*p* side, the present invention is not limited to the above-mentioned embodiments. For example, the magnetic-field generating member 50 may include the magnet 51, and the facing magnetic pole 51*a* of the magnet 51 may have an opposite polarity to the magnetic poles of the fixed magnet body 25 of the developing roller 27. Alternatively, the magnetic-field generating member 50 may include the magnet 51, and the facing magnetic pole 51*a* of the magnet 51 may have the same polarity as that of the magnetic poles of the fixed magnet body 25 of the developing roller 27. Further alternatively, the magnet 51 of the magnetic-field generating member 50 may be arranged between the N pole and the S pole of the fixed magnet body 25, and the magnetic force of the magnet 51 may be set in advance to be relatively high so that a magnetic brush is formed by the magnetic force of the magnet 51. Even when toner adhering to the surface of the developing roller 27 is scraped off by magnetic fields formed in those cases, the same advantages as those in the above-mentioned embodiments are obtained.

(Seventh Embodiment)

Figure 12:
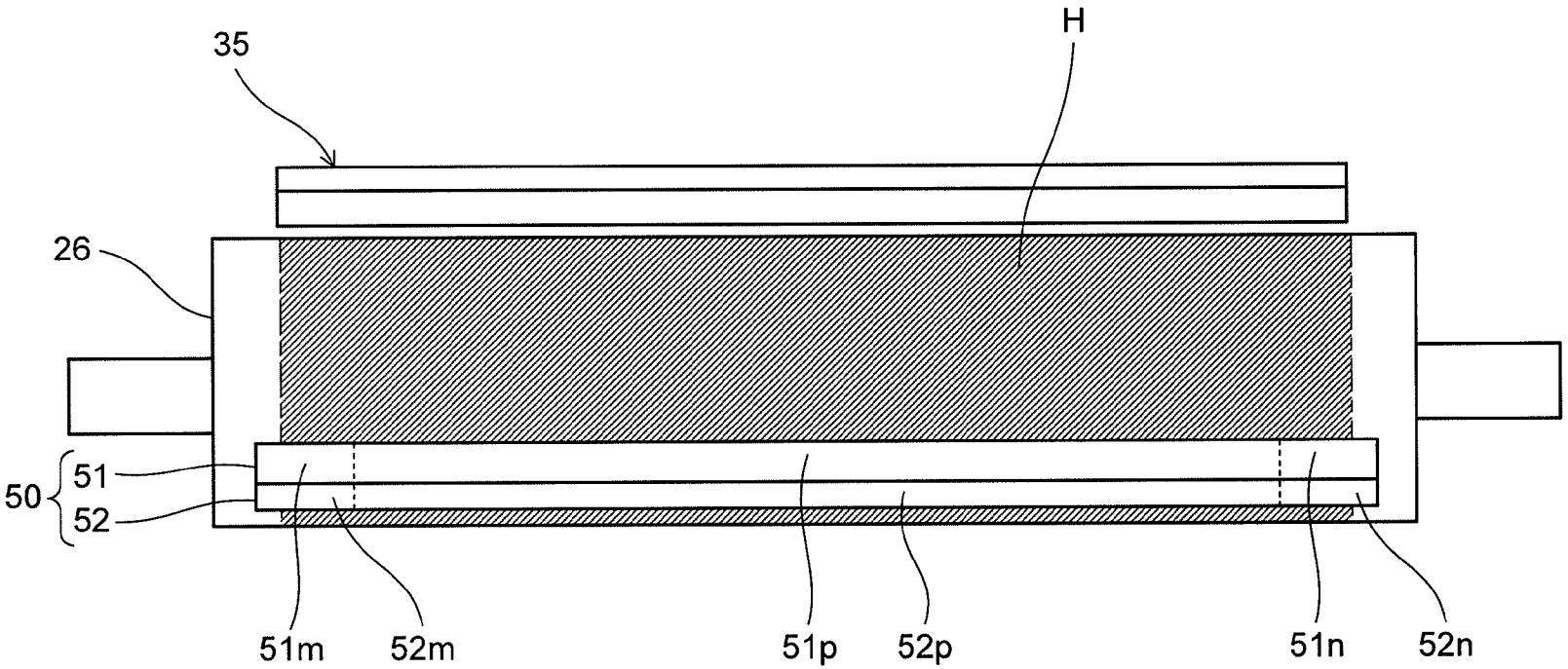
FIG. 12 is a plan view of a magnetic-field generating member and a regulating member of a developing device according to a seventh embodiment of the present invention.

Next, description is made of the magnetic-field generating member according to a seventh embodiment of the present invention with reference to FIG. 12. FIG. 12 is a plan view of the magnetic-field generating member and the regulating member. In the seventh embodiment, the magnetic force of the magnetic-field generating member varies in the longitudinal direction.

Similarly to that in the first embodiment (refer to FIG. 4), the magnetic-field generating member 50 includes the magnet 51 and the magnetic body 52. As illustrated in FIG. 4, the magnet 51 is a permanent magnet, and faces the surface of the developing sleeve 26 at a fixed interval. Further, the magnet 51 includes the facing magnetic pole 51*a* facing the magnetic pole N1 (N pole) of the fixed magnet body 25 through intermediation of the developing sleeve 26, and the opposite magnetic pole 51*b* positioned on the opposite side to that of the developing sleeve 26. The facing magnetic pole 51*a* has the same polarity (N pole) as that of the magnetic pole N1 of the fixed magnet body 25, and the opposite magnetic pole 51*b* is an S pole. The magnetic body 52 is made of a magnetic material such as stainless steel, and firmly attached by adhesive to the facing portion 51*c* of the magnet 51. Further, the magnetic body 52 includes the distal end portion 52*a* and the opposite facing portion 52*b*. The distal end portion 52*a* faces the surface of the developing sleeve 26 at the interval substantially equal to that between the facing magnetic pole 51*a* of the magnet 51 and the surface of the developing sleeve 26. The interval is set to be smaller than the interval between the surface of the developing sleeve 26 and the regulating member 35 (refer to FIG. 3). With this structure, the distal end portion 52*a* of the magnetic body 52 is magnetized to have an S pole, and the opposite facing portion 52*b* is magnetized to have an N pole.

Further, as illustrated in FIG. 12, the magnetic-field generating member 50 has the magnetic force varying in the longitudinal direction in the developer layer region H on the developing sleeve 26. In other words, the magnet 51 is provided with magnet end portions 51*m* and 51*n* and a magnet central portion 51*p*. The magnet end portions 51*m* and 51*n* are arranged on the end portions in the longitudinal direction of the developer layer region H, and a magnetic force of the facing magnetic pole 51*a* (refer to FIG. 4) of each of the magnet end portions 51*m* and 51*n* is set to be relatively high. Meanwhile, the magnet central portion 51*p* is arranged on the central portion in the longitudinal direction of the developer layer region H, and a magnetic force of the facing magnetic pole 51*a* (refer to FIG. 4) of the magnet central portion 51*p* is set to be lower than those of the magnet end portions 51*m* and 51*n*.

The magnetic-field generating end portions 52*m* and 52*n* of the magnetic body 52 face the magnet end portions 51*m* and 51*n*, and the magnetic-field generating central portion 52*p* faces the magnet central portion 51*p*. Thus, a magnetic force of the distal end portion 52*a* (refer to FIG. 4) of each of the magnetic-field generating end portions 52*m* and 52*n* is higher than a magnetic force of the distal end portion 52*a* of the magnetic-field generating central portion 52*p*.

Although the magnetic field is formed by the magnetic-field generating member 50 and the magnetic pole N1 of the fixed magnet body 25, the magnetic field is different in magnitude on the end portion sides and the central portion in the longitudinal direction. In accordance with the magnitudes of the magnetic fields on the end portion sides and the central portion in the longitudinal direction of the developer layer region H, residual toner after development on the surface of the developing sleeve 26 is scraped off. As a result, new toner is carried on the developing sleeve 26 under the state in which there is no disturbance of the toner layer on the developing sleeve 26.

(Eighth Embodiment)

Figure 13:
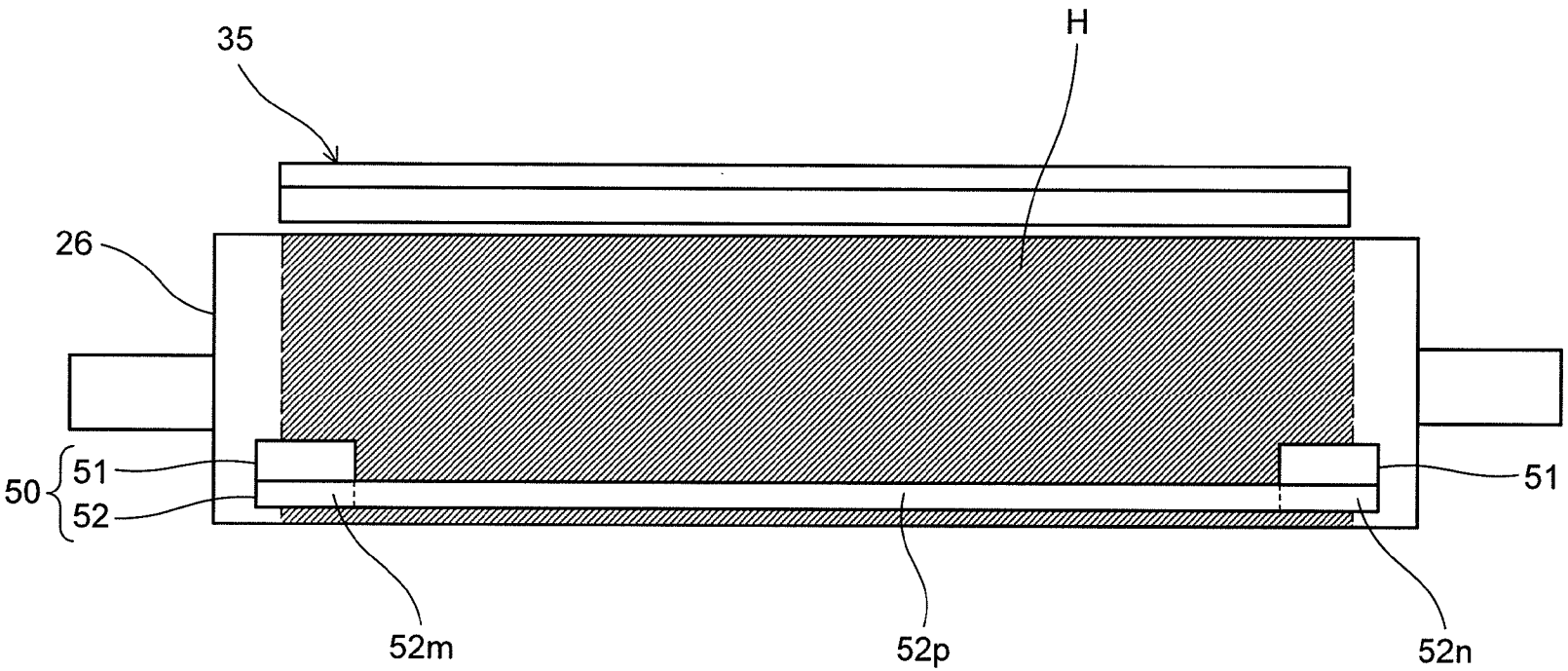
FIG. 13 is a plan view of a magnetic-field generating member and a regulating member of a developing device according to an eighth embodiment of the present invention.

Next, description is made of a modification of the magnetic-field generating member with reference to FIG. 13. FIG. 13 is a plan view of the magnetic-field generating member and the regulating member. In an eighth embodiment, the magnet 51 of the magnetic-field generating member 50 is different from that in the seventh embodiment.

Similarly to the seventh embodiment, the magnetic body 52 of the magnetic-field generating member 50 is made of a magnetic material such as a stainless steel plate, extends to both the end portions in the longitudinal direction of the developer layer region H, and faces the surface of the developing sleeve 26 at a fixed interval.

The magnets 51 are permanent magnets, and face the surface of the developing sleeve 26 at a fixed interval while having the same polarity as that of the magnetic pole N1 of the fixed magnet body 25 (refer to FIG. 4). Further, the magnets 51 are arranged only on the both-end-portion sides of the developer layer region H. In other words, the magnets 51 are arranged in ranges corresponding to the magnet end portions 51*m* and 51*n* in the seventh embodiment. Still further, the magnets 51 are firmly attached by adhesive to the downstream surface of the magnetic body 52 in the rotational direction of the developing roller. Note that, the magnets 51 may be attached to the upstream surface of the magnetic body 52 in the rotational direction of the developing roller.

Accordingly, similarly to the seventh embodiment, on the end-portion sides of the developer layer region H, the distal end portion 52*a* (refer to FIG. 4) of each of the magnetic-field generating end portions 52*m* and 52*n* of the magnetic body 52 is magnetized by the magnets 51. Thus, there are formed magnetic lines of force passing between the distal end portion 52*a* of each of the magnetic-field generating end portions 52*m* and 52*n* and the facing magnetic pole 51*a* of each of the magnets 51 (refer to FIG. 4). Further, there are formed magnetic lines of force passing between the distal end portion 52*a* of each of the magnetic-field generating end portions 52*m* and 52*n* and the fixed magnet body 25. Magnetic fields corresponding to the magnetic lines of force are formed at the distal end portion 52*a* of each of the magnetic-field generating end portions 52*m* and 52*n* and on the developing sleeve 26.

Meanwhile, on the central portion side of the developer layer region H, the distal end portion 52*a* (refer to FIG. 4) of the magnetic-field generating central portion 52*p* of the magnetic body 52 is magnetized to have an opposite magnetic pole to that of the magnetic pole N1 (refer to FIG. 4) of the fixed magnet body 25. As a result, there are formed magnetic lines of force passing between the distal end portion 52*a* of the magnetic-field generating central portion 52*p* and the magnetic pole N1 of the fixed magnet body 25. A magnetic field corresponding to the magnetic lines of force is formed at the distal end portion 52*a* of the magnetic-field generating central portion 52*p* and on the surface of the developing sleeve 26.

In this way, the magnetic fields on the end portion sides and the central portion side in the developer layer region H are relatively small on the central portion side and relatively large on the end portion sides. The respective magnetic fields cause residual developer after development on the surface of the developing sleeve 26 to be scraped off. As a result, new toner is carried on the developing sleeve 26 under the state in which there is no disturbance of the toner layer on the developing sleeve 26.

(Ninth Embodiment)

Figure 14:
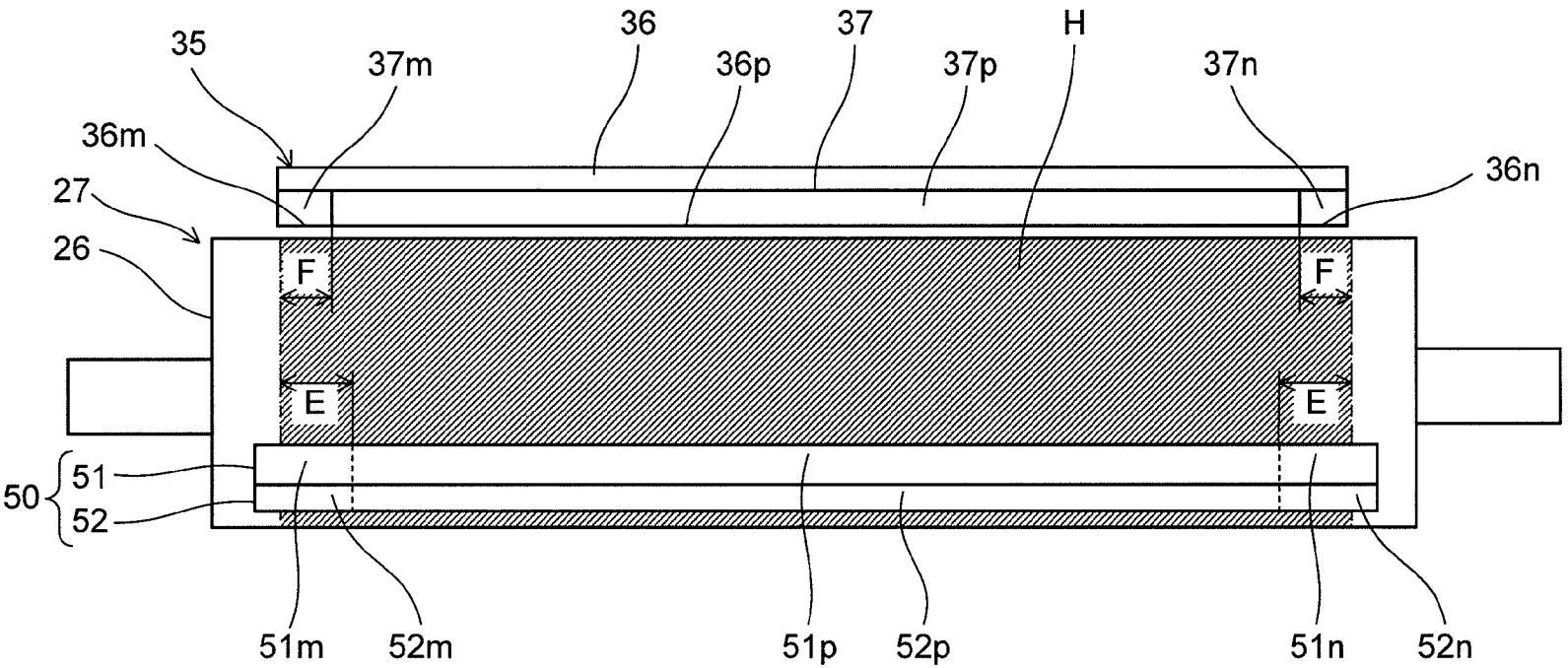
FIG. 14 is a plan view of a magnetic-field generating member and a regulating member of a developing device according to a ninth embodiment of the present invention.

FIG. 14 is a plan view of the magnetic-field generating member, the regulating member, and the developing roller according to a ninth embodiment. In the ninth embodiment, the magnetic-field generating member 50 is constituted correspondingly to the regulating member 35 having higher magnetic forces on the end portion sides.

As described above, the magnetic forces on the end portions in the longitudinal direction of the fixed magnet body 25 in the developing roller 27 and the plate magnet 37 of the regulating member 35 are lower than those on the central portion side thereof, and hence disturbance of the toner layer is liable to occur. In order to prevent the disturbance, as illustrated in FIG. 14, magnetic forces of the plate-magnet end portions 37*m* and 37*n* formed on the end portion sides of the plate magnet 37 are set to be higher than magnetic force of a plate-magnet central portion 37*p* formed on the central portion side thereof.

However, at the time of setting of the magnetic forces of the plate-magnet end portions 37*m* and 37*n* and the plate-magnet central portion 37*p*, when the magnetic forces of the plate-magnet end portions 37*m* and 37*n* are excessively high, magnetic forces of end-portion regulating portions 36*m* and 36*n* of the regulating blade 36 are also excessively higher than magnetic force of a central regulating portion 36*p* in accordance therewith. As a result, a height difference is formed between a toner layer on each of the end portion sides and a toner layer on the central portion side in the developer layer region H.

In this context, although the magnetic-field generating member 50 in this embodiment includes the magnetic body 52 and the magnet 51 similarly to those in the seventh embodiment, a distance E in the longitudinal direction of each of the magnetic-field generating end portions 52*m* and 52*n* of the magnetic body 52 is set to be longer than a distance F in the longitudinal direction of each of the end-portion regulating portions 36*m* and 36*n* of the plate magnet 37. Note that, both the distances E and F are set based on the end portions of the developer layer region H.

As a result of setting of the distances E and F as just described above, the magnetic-field generating end portions 52*m* and 52*n* of the magnetic body 52 are provided so as to face the developer layer region H while including a part of the developer layer region H, the part corresponding to a boundary between each of the end-portion regulating portions 36*m* and 36*n* and the central regulating portion 36*p* of the regulating member 35. In addition, each of the distal end portions 52*a* (refer to FIG. 4) of the magnetic-field generating end portions 52*m* and 52*n* of the magnetic body 52 has a magnetic force higher than a magnetic force of the distal end portion 52*a* of the magnetic-field generating central portion 52*p*. With this, when scraping off residual toner after development on the surface of the developing sleeve 26, the magnetic-field generating member 50 scrapes off the residual toner in a manner of eliminating the height difference of the toner layer, which is generated on the boundary part between each of the end-portion regulating portions 36*m* and 36*n* and the central regulating portion 36*p* of the regulating member 35.

Note that, in order to eliminate the height difference of the toner layer, the magnetic-field generating member in the eighth embodiment (refer to FIG. 13) may be employed. In this case, the two magnets 51 are attached so that one ends thereof are arranged at the distance E, and arranged so as to include a part of the developer layer region H, the part corresponding to the boundary between each of the end-portion regulating portions 36*m* and 36*n* and the central regulating portion 36*p* of the regulating member 35.

According to the seventh to ninth embodiments, the developing device 14 includes the following: the developing roller 27 incorporating the fixed magnet body 25 having the plurality of magnetic poles in the circumferential direction, for supplying toner to the developing region D facing the photosensitive member 11; the regulating member 35 for regulating an amount of the toner on the developing roller 27 so as to form the developer layer region H by means of the magnetic field formed also by the magnetic pole S1 of the fixed magnet body 25, the magnetic pole 51 facing the developing roller 27; and the magnetic-field generating member 50 for scraping off, on the upstream of the regulating member 35 in the rotational direction of the developing roller, toner which is not used for development on the developing roller 27. The magnetic-field generating member 50 includes the magnetic-field generating end portions 52*m* and 52*n* respectively facing the both-end-portions in the longitudinal direction of the developer layer region H, and the magnetic-field generating central portion 52*p* sandwiched in the longitudinal direction between the magnetic-field generating end portions 52*m* and 52*n*. The magnetic-field generating end portion 52*m* has a magnetic force higher than a magnetic force of the magnetic-field generating central portion 52*p*.

With this structure, even when the toner layer thickness in the developer layer region H is larger on the end portions than on the central portion in the longitudinal direction, and residual toner after development is left on the surface of the developing roller 27, the residual toner on the central portion side and the end portion sides is reliably scraped off by the respective magnetic fields of the magnetic-field generating member 50. Thus, there is no disturbance of the toner layer on the developing roller 27. As a result, satisfactory images can be obtained.

Further, according to the seventh and ninth embodiments, the magnetic-field generating member 50 includes the magnetic body 52 extending in the longitudinal direction of the developer layer region H and facing the surface of the developing roller 27, and the magnet 51 which includes the facing magnetic pole 51*a* facing the surface of the developing roller 27 and which is attached to the magnetic body 52 while facing the magnetic body 52 in the rotational direction of the developing roller. The facing magnetic pole 51*a* of the magnet 51 has the same polarity as that of the magnetic pole N1 of the fixed magnet body 25. The magnet end portion 51*m* of the magnet 51 has a magnetic force higher than a magnetic force of the magnet central portion 51*p* of the magnet 51.

With this, the distal end portion 52*a* of the magnetic body 52 is magnetized to have the opposite magnetic pole to that of the facing magnetic pole 51*a* of the magnet 51, and the magnetic lines of force are formed, which pass between the distal end portion 52*a* of the magnetic body 52 and the facing magnetic pole 51*a* of the magnet 51. Further, the magnetized magnetic pole of the distal end portion 52*a* of the magnetic body 52 has an opposite polarity also to that of the magnetic pole N1 of the fixed magnet body 25, and the magnetic lines of force are formed, which pass between the distal end portion 52*a* of the magnetic body 52 and the fixed magnet body 25. The magnetic fields corresponding to the magnetic lines of force are relatively small on the central portion side in the developer layer region H and relatively large on the end portion sides in the developer layer region H. The respective magnetic fields cause residual toner after development on the surface of the developing roller 27 to be scraped off. Accordingly, even when the toner layer thickness in the developer layer region H is larger on the end portions than on the central portion in the longitudinal direction, and residual toner is left on the surface of the developing roller 27 after development, the residual toner is reliably scraped off. Thus, there is no disturbance of the toner layer on the developing roller 27. As a result, satisfactory images can be obtained.

Further, according to the eighth embodiment, the magnetic-field generating member 50 includes the magnetic body 52 extending in the longitudinal direction of the developer layer region H and facing the surface of the developing roller 27, and the magnet 51 which includes the facing magnetic pole 51*a* facing the surface of the developing roller 27 and which is attached to the magnetic body 52 facing the developing roller 27 in the rotational direction of the developing roller. The magnetic body 52 extends to both the end portions in the longitudinal direction of the developer layer region H. The magnet 51 includes the pair of magnets 51 arranged so as to face the both-end-portions in the longitudinal direction of the developer layer region H. The facing magnetic pole 51*a* of each of the pair of magnets 51 has the same polarity as that of the magnetic pole N1 of the fixed magnet body 25.

With this, on the end-portion sides of the developer layer region H, the distal end portion 52*a* of the magnetic body 52 is magnetized to have the opposite magnetic pole to that of the facing magnetic pole 51*a* of the magnet 51, and the magnetic lines of force are formed, which pass between the distal end portion 52*a* of the magnetic body 52 and the facing magnetic pole 51*a* of the magnet 51. Further, the magnetized magnetic pole of the distal end portion 52*a* of the magnetic body 52 has an opposite polarity also to that of the magnetic pole N1 of the fixed magnet body 25, and the magnetic lines of force are formed, which pass between the distal end portion 52*a* of the magnetic body 52 and the fixed magnet body 25. The magnetic fields corresponding to those two magnetic paths each constituted by the magnetic lines of force are formed at the distal end portion 52*a* of the magnetic body 52 and on the surface of the developing roller 27. Meanwhile, on the central portion side in the developer layer region H, the distal end portion 52*a* of the magnetic body 52 is magnetized to have the opposite magnetic pole to that of the magnetic pole N1 of the fixed magnet body 25, and the magnetic fields of the distal end portion 52*a* of the magnetic body 52 and the magnetic pole N1 of the fixed magnet body 25 are formed at the distal end portion 52*a* of the magnetic body 52 and on the surface of the developing roller 27. With this, the magnetic field on the end portion sides and the central portion side in the developer layer region H is relatively small on the central portion side and relatively large on the end portion sides. Thus, residual toner after development on the surface of the developing roller 27 is scraped off by magnetic fields, respectively. Accordingly, even when the toner layer thickness in the developer layer region H is larger on the end portions than on the central portion in the longitudinal direction, and residual toner is left on the surface of the developing roller 27, the residual toner is reliably scraped off. Thus, there is no disturbance of the toner layer on the developing roller 27. As a result, satisfactory images can be obtained.

Further, according to the ninth embodiment, the regulating member 35 includes the end-portion regulating portions 36*m* and 36*n* facing the both-end-portions in the longitudinal direction of the developer layer region H, and the central regulating portion 36*p* sandwiched in the longitudinal direction between the end-portion regulating portions 36*m* and 36*n*. The end-portion regulating portion 36*m* has a magnetic force higher than a magnetic force of the central regulating portion 36*p*. The magnetic-field generating end portion 52*m* of the magnetic-field generating member 50 is formed so as to face the developer layer region H while including the part of the developer layer region H, the part corresponding to the boundary between the end-portion regulating portion 36*m* and the central regulating portion 36*p*.

At the time of formation of the developer layer region H with use of the regulating member 35, when the magnetic force of the end-portion regulating portion 36*m* is higher than the magnetic force of the central regulating portion 36*p*, a height difference is formed between the toner layer on each of the end portion sides and the toner layer on the central portion side of the developer layer region H. However, the magnetic-field generating end portion 52*m* of the magnetic-field generating member 50 is provided so as to face the developer layer region H while including a part of the developer layer region H, the part corresponding to the boundary between the end-portion regulating portion 36*m* and the central regulating portion 36*p* of the regulating member 35. Thus, when scraping off residual toner after development on the surface of the developing roller 27, the magnetic-field generating member 50 scrapes off the residual toner in a manner of eliminating the height difference of the toner layer. Thus, there is no disturbance of the toner layer on the developing roller 27. As a result, satisfactory images can be obtained.

(Tenth Embodiment)

Figure 15:
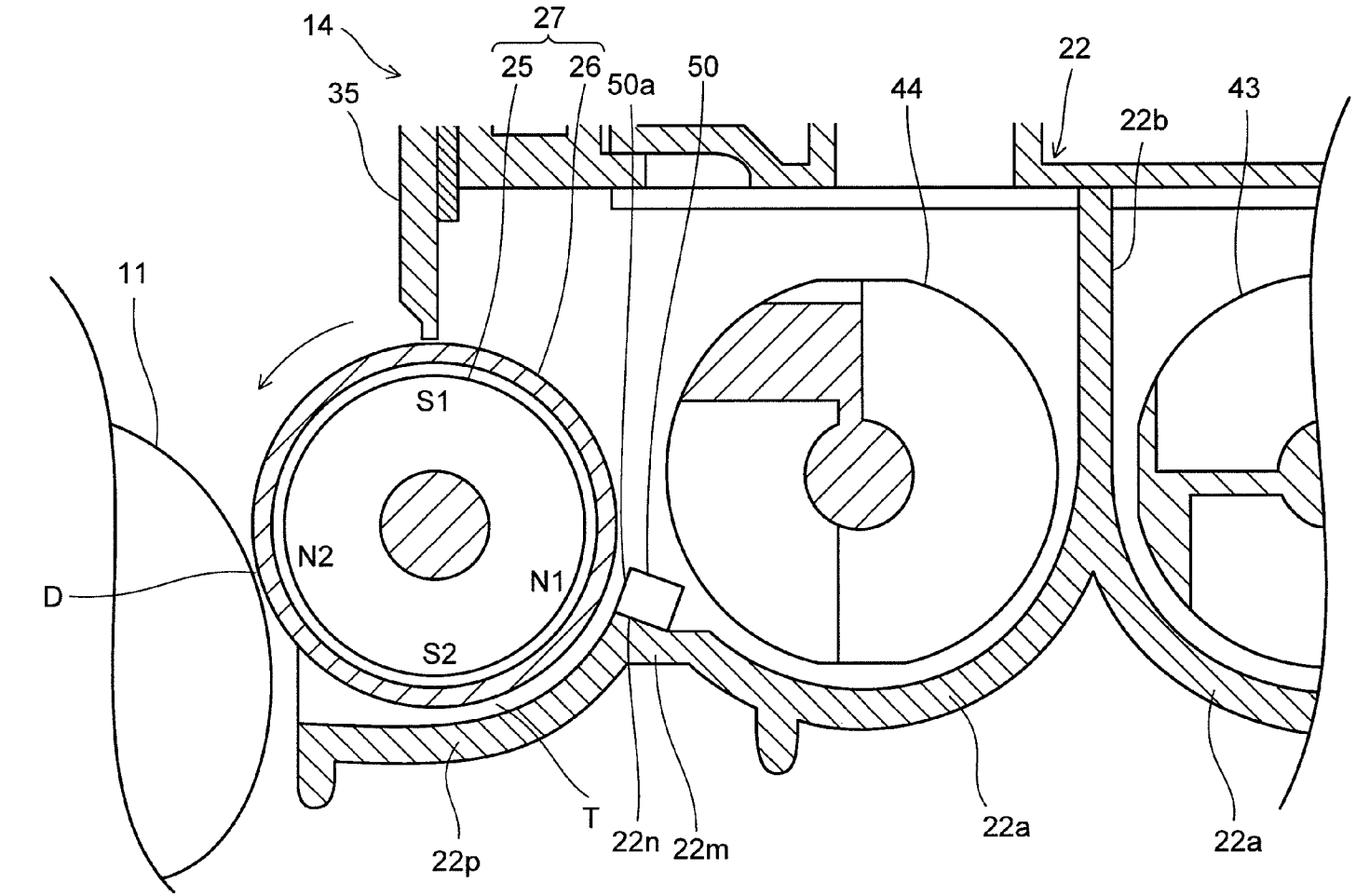
FIG. 15 is a sectional side view of a main-portion structure of the developing device according to a tenth embodiment of the present invention.
Figure 16:
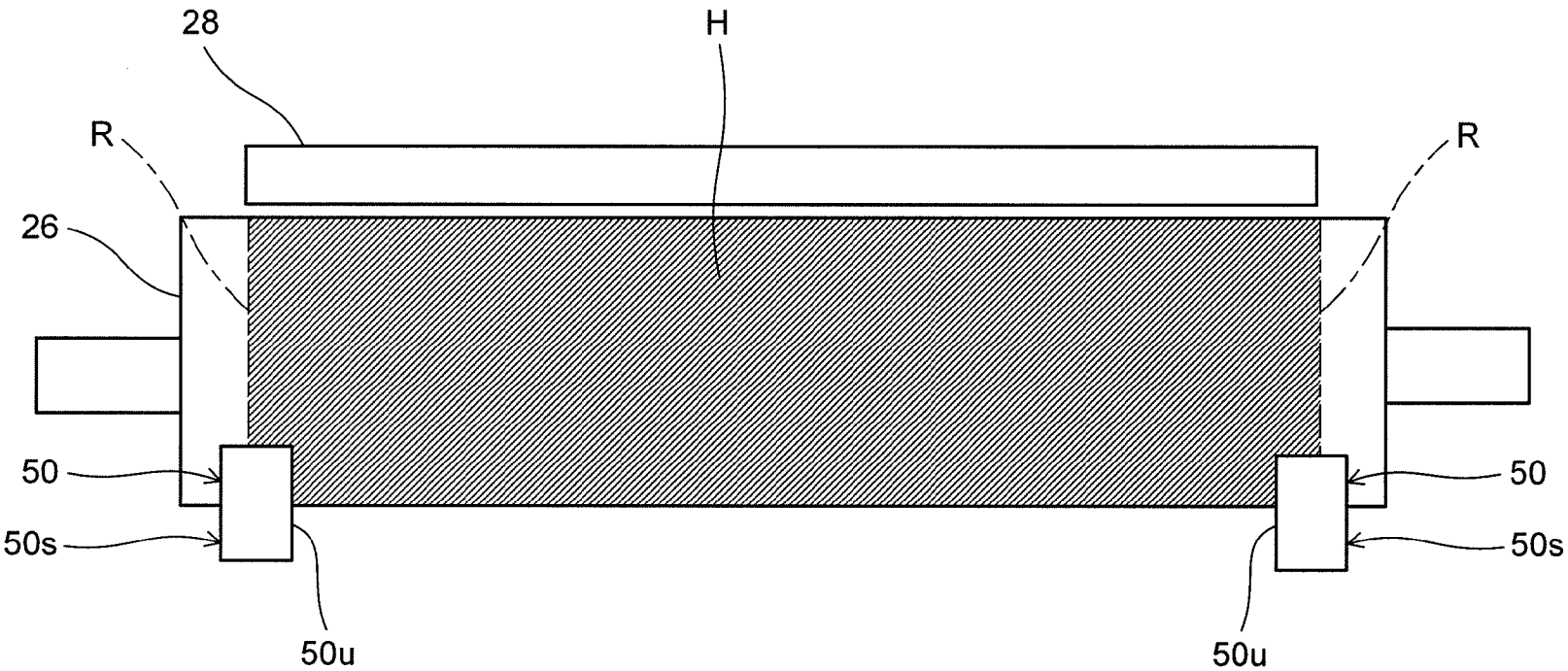
FIG. 16 is a plan view of a magnetic-field generating member and a regulating member of a developing device according to the tenth embodiment of the present invention.

Next, detailed description is made of the developing device according to a tenth embodiment with reference to FIGS. 15 and 16. FIG. 15 is a sectional side view of a main-portion structure of the developing device, and FIG. 16 is a plan view of the magnetic-field generating member and the regulating member. Note that, the tenth embodiment is different from the first embodiment in arrangement of the magnetic-field generating member. Meanwhile, other members including the developing roller 27, the regulating member 35, the stirring members 43 and 44 have the same structures as those in the first embodiment, and detailed description thereof is omitted.

As illustrated in FIG. 15, the magnetic-field generating member 50 is attached to the attachment portion 22*n* of the developing container 22. When the magnetic-field generating member 50 is firmly attached by adhesive to the attachment portion 22*n*, the magnetic-field generating member 50 is arranged at a fixed interval with respect to the surface of the developing sleeve 26. The interval is set to be smaller than the interval between the developing sleeve 26 and the regulating member 35. Further, the magnetic-field generating member 50 is constituted by a permanent magnet, and includes a facing surface portion 50*a* facing the magnetic pole N1 (N pole) of the fixed magnet body 25. The facing surface portion 50*a* has the same polarity (N pole) as that of the magnetic pole N1 of the fixed magnet body 25, and generates a repulsive magnetic field between the facing surface portion 50*a* and the magnetic pole N1.

Further, as illustrated in FIG. 16, the magnetic-field generating member 50 includes a pair of magnetic-field generating members 50 arranged so as to face the both-end-portions in the longitudinal direction of the developer layer region H. Specifically, each of the magnetic-field generating members 50 has a rectangular shape, and includes an inner surface portion 50*u* and an outer surface portion 50*s* as planes thereof. Each of the inner surface portion 50*u* and the outer surface portion 50*s* is arranged in parallel with a boundary line R in the longitudinal direction of the developer layer region H. Further, each of the inner surface portions 50*u* is arranged in the developer layer region H facing the magnetic-field generating members 50; meanwhile, each of the outer surface portions 50*s* is arranged out of the developer layer region H facing the magnetic-field generating members 50. Thus, the facing surface portion 50*a* (refer to FIG. 15) of each of the magnetic-field generating members 50 faces the developer layer region H, and also the boundary line R of the developer layer region H. Note that, when the facing surface portion 50*a* of each of the magnetic-field generating members 50 faces the boundary line R of the developer layer region H, the outer surface portion 50*s* of each of the magnetic-field generating members 50 may be arranged so as to face the boundary line R of the developer layer region H.

The repulsive magnetic field formed by the facing surface portion 50*a* and the magnetic pole N1 of the fixed magnet body 25 causes toner on the end portions in the longitudinal direction of the developer layer region H to be scraped off from the surface of the developing sleeve 26.

Around the developing sleeve 26, the regulating member 35, the developing region D facing the photosensitive member 11, the toner circulating region T formed between the developing sleeve 26 and the developer supplying portion 22*p*, and the magnetic-field generating members 50 are arranged in the stated order along an arrow direction of FIG. 15 (rotational direction of the developing sleeve 26).

Normally, the magnetic force of the fixed magnet body 25 in the developing roller 27 is lower on the end portion sides than on the central portion. Further, the magnetic force of the magnet of the regulating member 35 is lower on the end portion sides than on the central portion. After repeated development, a toner layer thickness gradually increases on the end portion sides than on the central portion of the developer layer region H.

However, in this embodiment, residual toner after development on the both-end-portion sides of the developer layer region H on the developing sleeve 26 is scraped off from the surface of the developing sleeve 26 by the repulsive magnetic field formed by the facing surface portion 50*a* of each of the magnetic-field generating members 50 and the magnetic pole N1 of the fixed magnet body 25. Then, new toner is carried on the developing sleeve 26 under the state in which there is no disturbance of the toner layer on the developing sleeve 26.

(Eleventh Embodiment)

Figure 17:
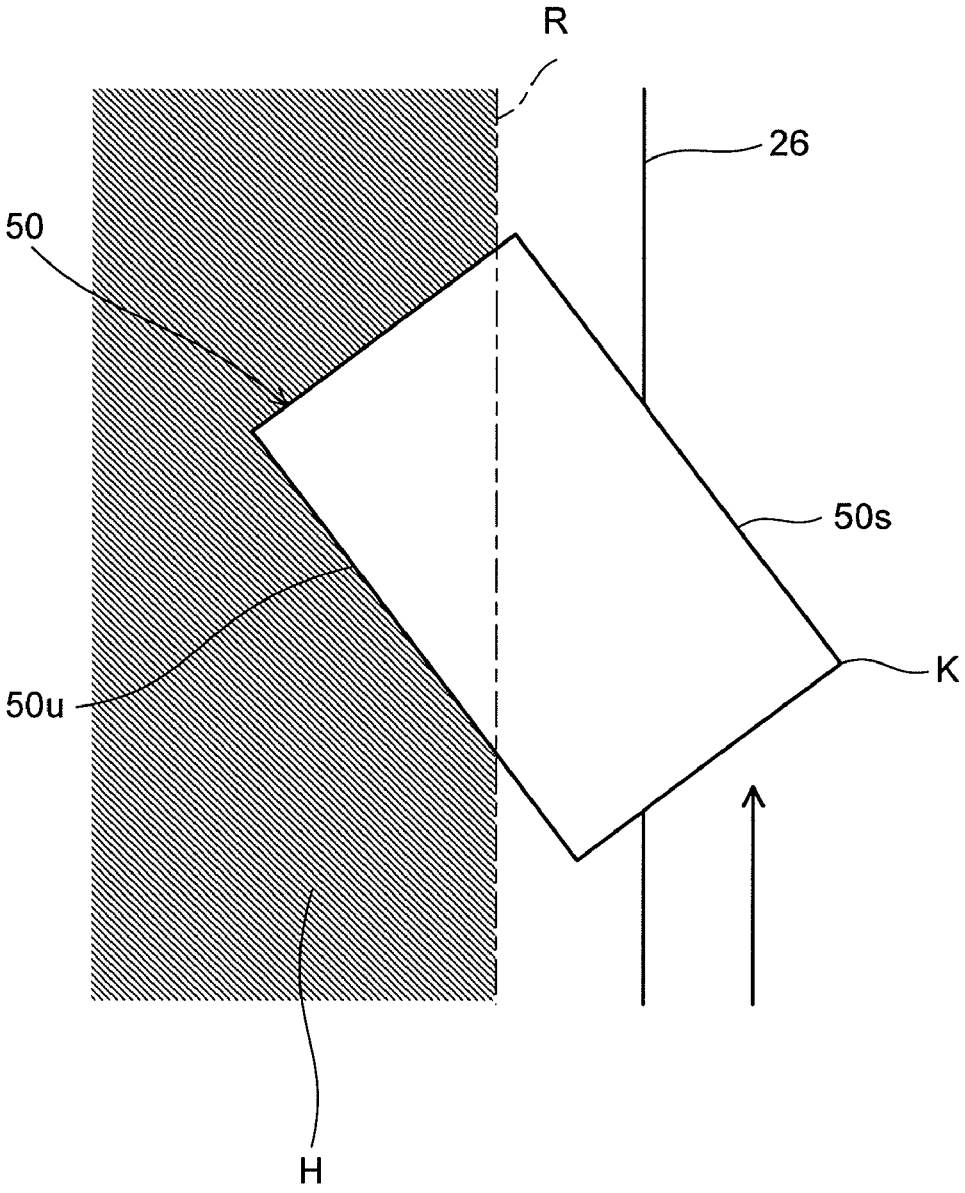
FIG. 17 is a plan view of one of magnetic-field generating members of a developing device according to an eleventh embodiment of the present invention.

Next, description is made of a modification of the arrangement of the magnetic-field generating members with reference to FIG. 17. FIG. 17 is a plan view of one of the magnetic-field generating members.

The magnetic-field generating members 50 are arranged on the both-end-portion sides of the developer layer region H at a fixed interval with respect to the surface of the developing sleeve 26. Further, each of the magnetic-field generating members 50 is constituted by a permanent magnet, and generates a repulsive magnetic field between each of the magnetic-field generating members 50 and a magnetic pole of the fixed magnet body 25 (refer to FIG. 15), the magnetic pole facing the magnetic-field generating members 50.

Further, each of the magnetic-field generating members 50 has a rectangular shape, and includes an inner surface portion 50*u* and an outer surface portion 50*s* as planes thereof. Each of the inner surface portion 50*u* and the outer surface portion 50*s* is arranged in a manner of being inclined with respect to the boundary line R of the developer layer region H. The inclined direction is inclined to the central side in the developer layer region H from the upstream to the downstream in the rotational direction of the developing roller (arrow direction of FIG. 17).

A downstream side of the inner surface portion 50*u* is arranged in the developer layer region H which the magnetic-field generating members 50 face, and an upstream of the inner surface portion 50*u* is arranged out of the developer layer region H which the magnetic-field generating members 50 face. Meanwhile, the outer surface portion 50*s* is arranged out of the developer layer region H which the magnetic-field generating members 50 face. Note that, a downstream side of the outer surface portion 50*s* may be arranged in the developer layer region H which the magnetic-field generating members 50 face.

When the magnetic-field generating members 50 are arranged as just described above, the repulsive magnetic field of the facing surface portion 50*a* (refer to FIG. 15) of each of the magnetic-field generating members 50 causes toner adhering on the developing sleeve 26 to be scraped off. Then, although being stopped on the end portion sides of the developer layer region H, in accordance with the rotation of the developing sleeve 26, the toner thus scraped off is conveyed from the end portion sides to the central side of the developer layer region H along the inclined inner surface portions 50*u*. Then, toner is carried on the developing sleeve 26 under the state in which there is no disturbance of the toner layer on the developing sleeve 26, and the toner carried thereon is regulated by the regulating member 35 (refer to FIG. 15) so as to have a predetermined thickness, and toner uniformly adhering to the surface of the developing sleeve 26 is supplied to the photosensitive member 11.

(Twelfth Embodiment)

Figure 18A:
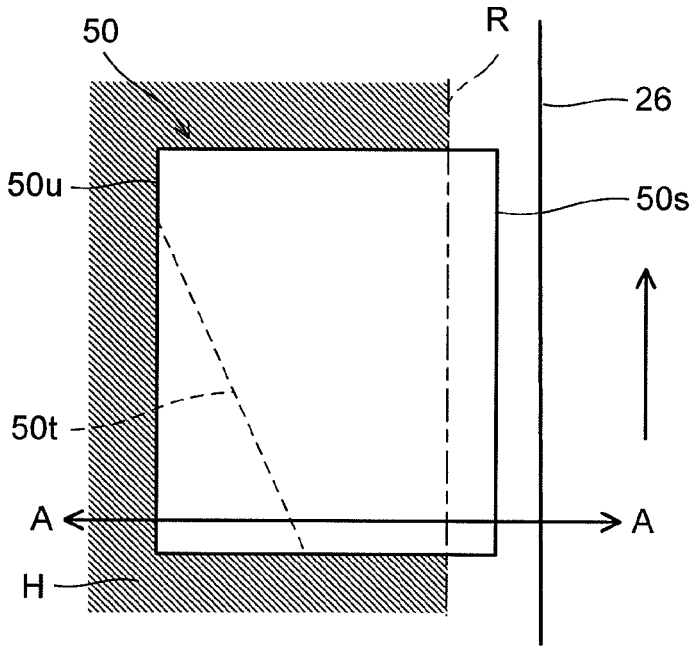
FIGS. 18A and 18B illustrate one of magnetic-field generating members of a developing device according to a twelfth embodiment of the present invention.
Figure 18B:
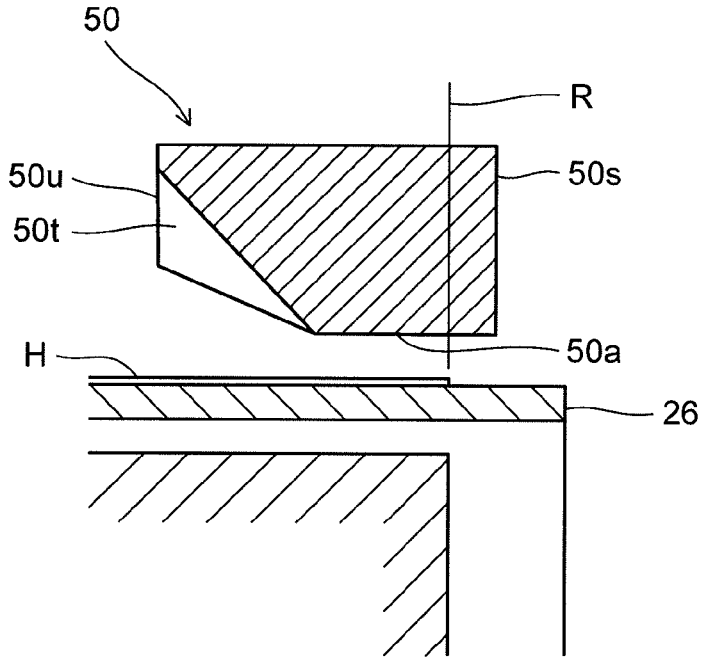

Further, FIGS. 18A and 18B illustrate a modification of the magnetic-field generating members. FIG. 18A is a plan view of one of the magnetic-field generating members, and FIG. 18B is a sectional view taken along the line A-A of FIG. 18A.

The magnetic-field generating members 50 are arranged on the both-end-portion sides of the developer layer region H at a fixed interval with respect to the surface of the developing sleeve 26. Further, each of the magnetic-field generating members 50 is constituted by a permanent magnet, and generates a repulsive magnetic field between each of the magnetic-field generating members 50 and a magnetic pole of the fixed magnet body 25, the magnetic pole facing the magnetic-field generating members 50.

Further, each of the magnetic-field generating members 50 has a rectangular shape, and includes an inner surface portion 50*u* and an outer surface portion 50*s* as planes thereof. Each of the inner surface portion 50*u* and the outer surface portion 50*s* is arranged in parallel with the boundary line R of the developer layer region H. Further, the inner surface portion 50*u* is arranged in the developer layer region H which the magnetic-field generating members 50 face. Meanwhile, the outer surface portion 50*s* is arranged out of the developer layer region H which the magnetic-field generating members 50 face. Note that, the outer surface portion 50*s* may be arranged on the boundary line R.

An inclined surface 50*t* is formed on the inner surface portion 50*u*. The inclined surface 50*t* is inclined to the central side of the developer layer region H from the upstream to the downstream in the rotational direction of the developing roller (arrow direction of FIG. 18A). In other words, the inclined surface 50*t* forms a predetermined angle with respect to the surface of the developing sleeve 26, the angle being formed to become smaller from the upstream side to the downstream side. However, this should not be construed restrictively. The inclined surface 50*t* may be orthogonal to the surface of the developing sleeve 26 and inclined with respect to the boundary line R.

Accordingly, the repulsive magnetic field of the facing surface portion 50*a* of each of the magnetic-field generating members 50 causes toner adhering on the developing sleeve 26 to be scraped off. Then, although being stopped on the end portion sides of the developer layer region H, in accordance with the rotation of the developing sleeve 26, the toner thus scraped off is conveyed from the end portion sides to the central side of the developer layer region H along the inclined surface 50*t*. Then, toner is carried on the developing sleeve 26 under the state in which there is no disturbance of the toner layer on the developing sleeve 26, and the toner carried thereon is regulated by the regulating member 35 (refer to FIG. 15) so as to have a predetermined thickness, and toner uniformly adhering to the surface of the developing sleeve 26 is supplied to the photosensitive member 11.

Note that, the magnetic-field generating members 50 are not limited in the above-mentioned embodiment. For example, the magnetic-field generating members 50 may be constituted by magnets, and the magnetic pole of the fixed magnet body 25 of the developing roller 27 may have an opposite polarity to that of the facing magnet pole of the magnet of each of the magnetic-field generating members 50. Further, the magnet of each of the magnetic-field generating members 50 is arranged between the N pole and the S pole of the fixed magnet body 25, and the magnetic force of the magnet of each of the magnetic-field generating members 50 is set in advance to be relatively high so that a magnetic brush is formed by the magnetic force of each of the magnetic-field generating members 50. Even when toner adhering to the surface of the developing roller 27 is scraped off by magnetic fields including that formed by the magnetic brush, the same advantages as those in the above-mentioned embodiments are obtained. Further, similarly to the first embodiment (refer to FIG. 4), each of the magnetic-field generating members 50 may include the magnet 51 and the magnetic body 52 and arranged as those in the tenth to twelfth embodiments.

According to the tenth to twelfth embodiments, the developing device 14 includes the following: the developing roller 27 incorporating the fixed magnet body 25 having the plurality of magnetic poles in the circumferential direction, for supplying toner to the developing region D facing the photosensitive member 11; the regulating member 35 for regulating an amount of the toner on the developing roller 27 so as to form the developer layer region H together with the fixed magnet body 25; and the magnetic-field generating member 50 for scraping off, on the upstream of the regulating member 35 in the rotational direction of the developing roller, toner which is not used for development on the developing roller 27. The magnetic-field generating member 50 includes the pair of magnetic-field generating members 50 arranged so as to face the both-end-portions in the longitudinal direction of the developer layer region H. The inner surface portion 50*u* of each of the magnetic-field generating members 50 is arranged so as to face each other in the developer layer region H. The outer surface portion 50*s* of each of the magnetic-field generating members 50 is arranged out of the developer layer region H, or arranged so as to face the boundary line R of the developer layer region H.

With this structure, even when toner has a layer thickness larger on the end portions in the longitudinal direction of the developer layer region H and is left on the surface of the developing roller 27 after development, the toner is scraped off by the magnetic-field generating members 50. In addition, the magnetic-field generating members 50 are arranged only on the end portions in the longitudinal direction, and hence the interval between the magnetic-field generating members 50 and the developing roller 27 is maintained in the longitudinal direction, and hence the magnetic field between the developing roller 27 and each of the magnetic-field generating members 50 is stabilized. Thus, the toner on the developing roller 27 is reliably scraped off, and hence there is no disturbance of the toner layer on the developing roller 27. As a result, satisfactory images can be obtained.

Further, according to the eleventh and twelfth embodiments, the inner surface portion 50*u* of each of the magnetic-field generating members 50 is inclined to the central side in the longitudinal direction from the upstream to the downstream in the rotational direction of the developing roller. With this, toner scraped off by the magnetic-field generating members 50 is conveyed from the end portion sides to the central side of the developer layer region H along the inclination of each of the magnetic-field generating members 50. Thus, there is no risk that the toner is stopped on the end portion sides in the developer layer region H and the stopped toner leaks out of the developing device. Further, the toner can be dispersed in the longitudinal direction of the developer layer region H so as to be uniformly supplied to the regulating member.

Further, according to the twelfth embodiment, the inner surface portion 50*u* of each of the magnetic-field generating members 50 is provided with the inclined surface 50*t* forming a predetermined angle with respect to the surface of the developing roller. The angle formed by the inclined surface 50*t* becomes smaller from the upstream to the downstream in the rotational direction of the developing roller. With this, toner scraped off by the magnetic-field generating members 50 is conveyed from the end portion sides to the central side of the developer layer region H along the inclined surface 50*t* of each of the magnetic-field generating members 50. Thus, there is no risk that the toner is stopped on the end portion sides in the developer layer region H and the stopped toner leaks out of the developing device. Further, the toner can be dispersed in the longitudinal direction of the developer layer region H so as to be uniformly supplied to the regulating member.

Further, according to the tenth to twelfth embodiments, each of the magnetic-field generating members 50 is constituted by a magnet having the facing magnetic pole facing the surface of the developing roller 27, the facing magnetic pole of the magnet having the same polarity as that of the magnetic pole N1 of the fixed magnet body 25 facing the facing magnetic pole. With this, the repulsive magnetic field formed between the surface of the developing roller 27 and each of the magnetic-field generating members 50 causes residual toner after development on the surface of the developing roller 27 to be reliably scraped off.

(Thirteenth Embodiment)

Figure 19:
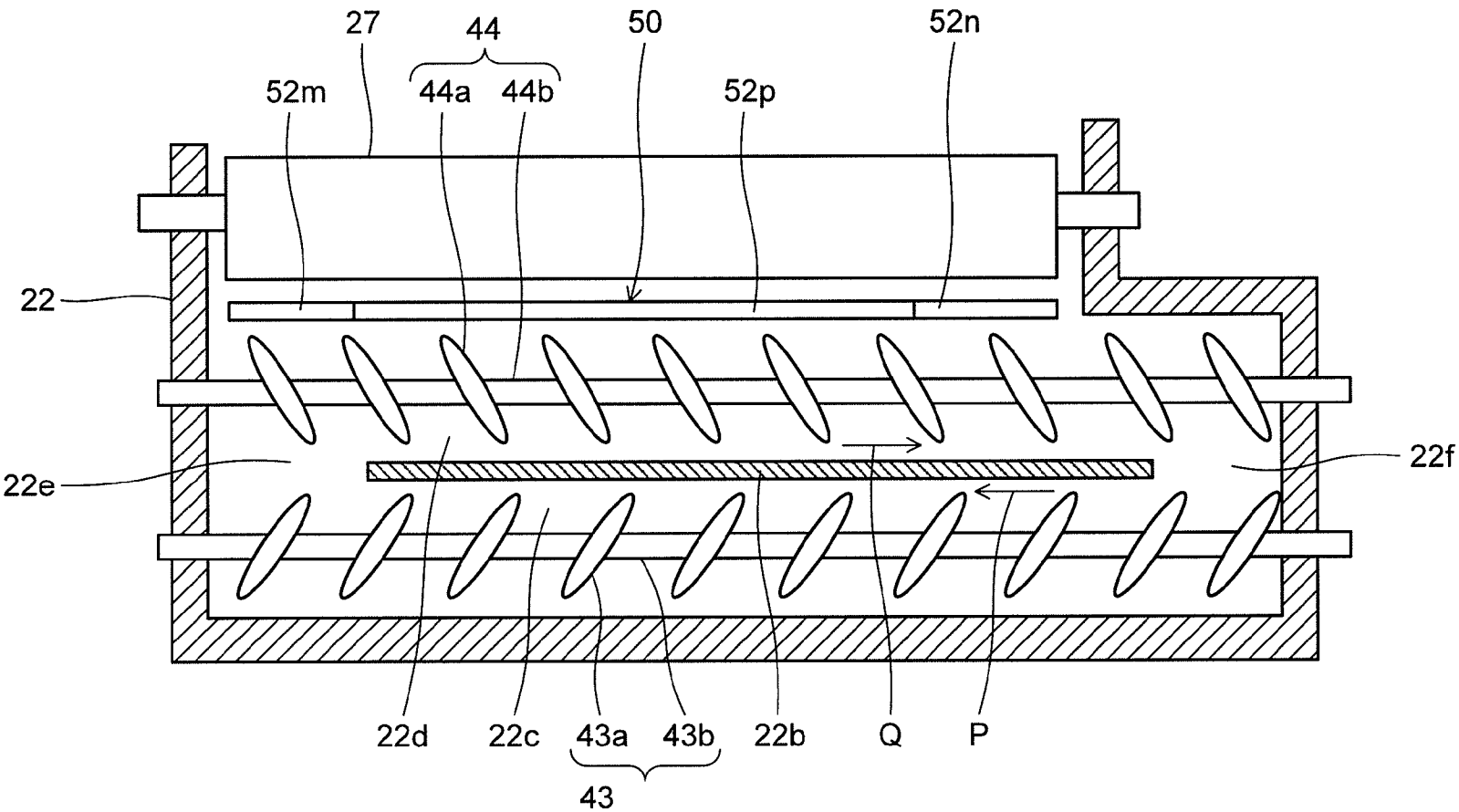
FIG. 19 is a sectional plan view of a magnetic-field generating member and a stirring portion of a developing device according to a thirteenth embodiment of the present invention.

FIG. 19 is a sectional plan view illustrating an arrangement of the magnetic-field generating member and a stirring portion according to a thirteenth embodiment. In the thirteenth embodiment, the stirring portion including stirring members is properly arranged with respect to the magnetic-field generating member 50.

As described above, the developing container 22 is provided with the first conveyance path 22*d*, the second conveyance path 22*c*, the partition portion 22*b*, a first communication portion 22*f*, and a second communication portion 22*e*. Then, the first conveyance path 22*d* and the second conveyance path 22*c* are arranged in parallel with the developing roller 27 in a substantially horizontal direction.

The partition portion 22*b* extends in the longitudinal direction of the developing container 22 and partitions the developing container 22 so that the first conveyance path 22*d* and the second conveyance path 22*c* are parallel to each other. The first communication portion 22*f* and the second communication portion 22*e* are provided on the both-end-portions in the longitudinal direction of the partition portion 22*b*. Toner is capable of circulating in the second conveyance path 22*c*, the second communication portion 22*e*, the first conveyance path 22*d*, and the first communication portion 22*f*.

The first stirring member 44 is arranged in the first conveyance path 22*d*, and the second stirring member 43 is arranged in the second conveyance path 22*c*.

The first stirring member 44 includes a rotary shaft 44*b* and a first helical blade 44*a* provided integrally with the rotary shaft 44*b* and helically formed at a fixed pitch in an axial direction of the rotary shaft 44*b*. Further, the first helical blade 44*a* is provided so as to extend to both-end-portions in a longitudinal direction of the first conveyance path 22*d*, and to face also the first communication portion 22*f* and the second communication portion 22*e* and the developing roller 27. The rotary shaft 44*b* is rotatably and axially supported by the developing container 22.

The second stirring member 43 includes a rotary shaft 43*b* and a second helical blade 43*a* provided integrally with the rotary shaft 43*b* and helically formed, in an axial direction of the rotary shaft 43*b*, of a blade directed in a direction reverse to that of the first helical blade 44*a* and having the same pitch as that of the first helical blade 44*a*. Further, the second helical blade 43*a* is provided so as to extend to both-end-portions in a longitudinal direction of the second conveyance path 22*c*, and to face also the first communication portion 22*f* and the second communication portion 22*e*. The rotary shaft 43*b* is arranged in parallel with the rotary shaft 44*b*, and rotatably and axially supported by the developing container 22.

When the rotary shaft 43*b* is rotated by a drive source such as a motor (not shown), the second helical blade 43*a* is rotated in accordance therewith and conveys toner in the second conveyance path 22*c* in a direction of an arrow P. Further, when the rotary shaft 44*b* in conjunction with the rotary shaft 43*b* is rotated, the first helical blade 44*a* is rotated in accordance therewith and conveys toner in the first conveyance path 22*d* in a direction of an arrow Q. As a result, the toner is circulatingly conveyed through the second conveyance path 22*c*, the second communication portion 22*e*, the first conveyance path 22*d*, and the first communication portion 22*f* in the stated order. Then, the toner thus stirred is supplied to the developing roller 27.

The magnetic-field generating member 50 is arranged so as to face the developing roller 27 between the developing roller 27 and the first stirring member 44, and to face also the first stirring member 44.

As just described above, the magnetic-field generating member 50 scraps off toner adhering to the developing roller 27; meanwhile, the magnetic field generated around the magnetic-field generating member 50 has an influence on the stirring portion.

As a countermeasure, in this embodiment, the first communication portion 22*f* is arranged at a position not facing the magnetic-field generating member 50. In other words, the first conveyance path 22*d* is extended on the downstream in a toner conveying direction (right side of FIG. 19) beyond a part thereof facing the magnetic-field generating member 50. Then, the second conveyance path 22*c* is extended on the upstream side (right side of FIG. 19) similarly to the first conveyance path 22*d*. In this way, the first communication portion 22*f* communicates a downstream-end-portion side of the first conveyance path 22*d* and an upstream-end-portion side of the second conveyance path 22*c* with each other in a direction orthogonal to the toner conveying directions P and Q.

The first communication portion 22*f* is separated from the magnetic-field generating member 50, specifically, from the magnetic-field generating end portion 52*n* having relatively high magnetic force. Thus, when toner having been conveyed through the first conveyance path 22*d* is conveyed in the first communication portion 22*f*, a magnetic force reverse to a toner moving direction does not prevent movement of the toner by acting thereon, and hence the toner is smoothly conveyed in the first communication portion 22*f*.

(Fourteenth Embodiment)

Figure 20:
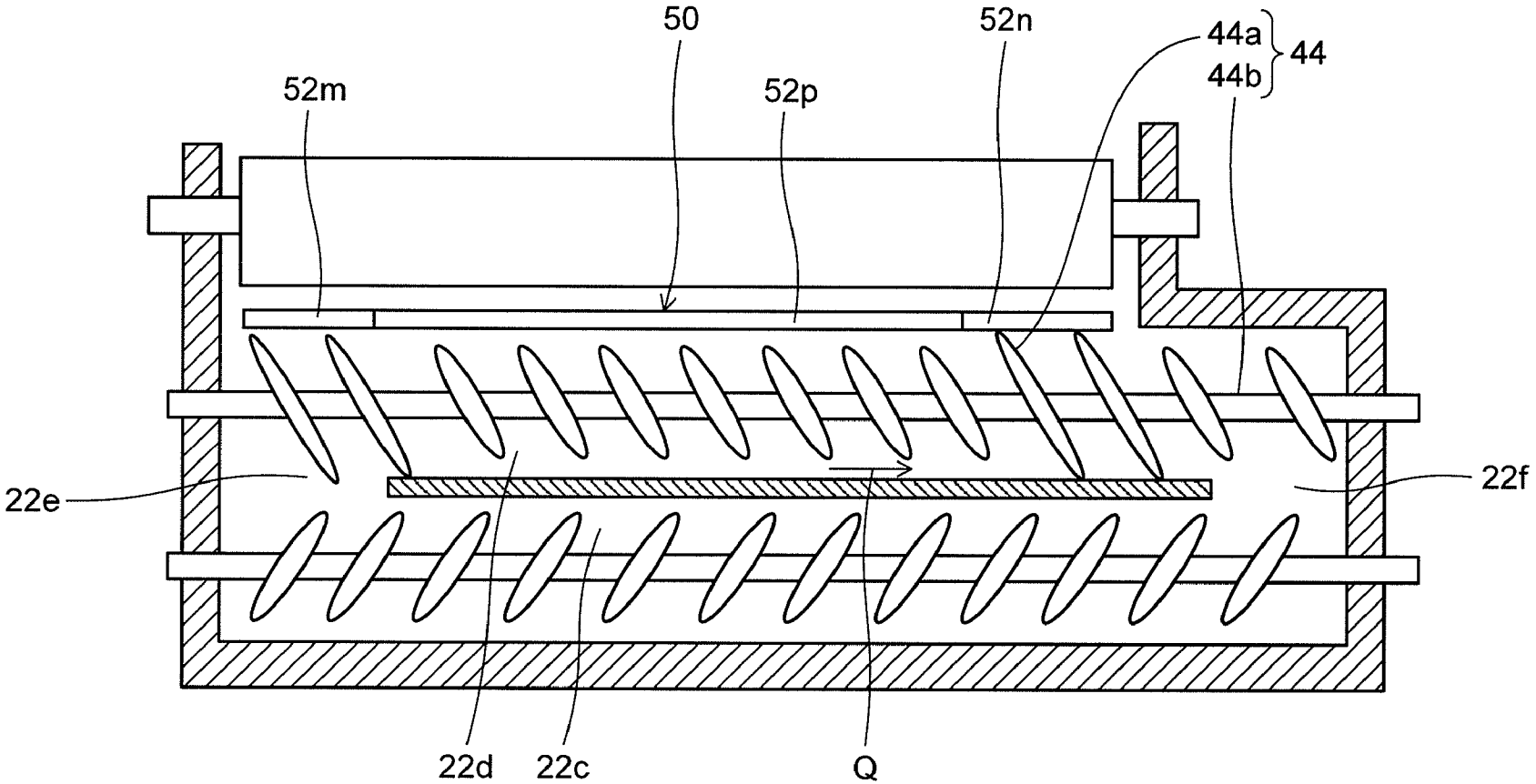
FIG. 20 is a sectional plan view of a magnetic-field generating member and a stirring portion of a developing device according to a fourteenth embodiment of the present invention.

Next, description is made of another embodiment in which toner is smoothly conveyed by the stirring portion. FIG. 20 is a sectional plan view illustrating an arrangement of the magnetic-field generating member and the stirring portion. In the fourteenth embodiment, the first conveyance path 22*d* and the second conveyance path 22*c* and the first communication portion 22*f* and the second communication portion 22*e* have the same structure as those in the thirteenth embodiment, and the first stirring member 44 has a different structure from that in the thirteenth embodiment.

The first stirring member 44 conveys toner in the first conveyance path 22*d* in the direction of the arrow Q with use of the helically-formed first helical blade 44*a*. The magnetic force of the magnetic-field generating member 50 acts on the toner in the direction orthogonal to the toner conveying direction Q. A relatively low magnetic force acts in the magnetic-field generating central portion 52*p* of the magnetic-field generating member 50, and a relatively high magnetic force acts at the magnetic-field generating end portion 52*n*. In a part of the first conveyance path 22*d*, which faces the magnetic-field generating end portion 52*n*, by the influence of the magnetic field, a toner moving speed decreases in comparison with a part of the first conveyance path 22*d*, which faces the magnetic-field generating central portion 52*p*.

As a countermeasure, a blade outer diameter of the first helical blade 44*a* is set to be larger at the part facing the magnetic-field generating end portion 52*n* of the magnetic-field generating member 50 than those at other parts. In proportion to the size of the first helical blade 44*a*, the toner conveying force increases. By increasing the toner conveying force as just described above, in the part of the first conveyance path 22*d*, which faces the magnetic-field generating end portion 52*n*, toner is conveyed against the magnetic force of the magnetic-field generating end portion 52*n* at substantially the same speed as that in the part of the first conveyance path 22*d*, which faces the magnetic-field generating central portion 52*p*, and hence the toner is smoothly conveyed in the first conveyance path 22*d*. Note that, also at a part facing the magnetic-field generating end portion 52*m* of the magnetic-field generating member 50, the blade outer diameter of the first helical blade 44*a* may be set to be larger. Alternatively, by increasing a blade pitch of the first helical blade 44*a*, the conveying force increases.

According to the thirteenth and fourteenth embodiments, the developing device 14 includes the following: the first stirring member 44 facing the developing roller 27, for supplying toner; the second stirring member 43 for stirring and conveying the toner together with the first stirring member 44; the first conveyance path 22*d* in which the toner is conveyed by the first stirring member 44; the second conveyance path 22*c* which is arranged in parallel with the first conveyance path 22*d* and in which the toner is conveyed by the second stirring member 43; the first communication portion 22*f* for allowing the toner to flow from the first conveyance path 22*d* to the second conveyance path 22*c*; and the second communication portion 22*e* for allowing the toner to flow from the second conveyance path 22*c* to the first conveyance path 22*d*. The magnetic-field generating member 50 is arranged between the developing roller 27 and the first stirring member 44, and the first communication portion 22*f* is arranged at the position not facing the magnetic-field generating member 50.

With this, the first stirring member 44 causes the toner to be conveyed, while being stirred, from the upstream to the downstream in the toner conveying direction in the first conveyance path 22*d*. Next, when moving from the first conveyance path 22*d* to the second conveyance path 22*c* through intermediation of the first communication portion 22*f*, the toner is conveyed which is not significantly influenced by the magnetic force of the magnetic-field generating member 50. Accordingly, the magnetic-field generating member 50 causes the toner on the developing roller 27 to be scraped off, and the toner uniformly circulates in the first conveyance path 22*d* and the second conveyance path 22*c*, and then is supplied to the developing roller 27. Thus, there is no risk of occurrence of image failures caused by density reduction, a ghost phenomenon, and the like.

Further, according to the fourteenth embodiment, the first stirring member 44 is formed to have a helical blade so as to convey toner, and the parts of the helical blade, which face the magnetic-field generating end portion 52*n* of the magnetic-field generating member 50, are formed to exert a high toner-conveying force.

With this, the toner conveyed in the first conveyance path 22*d* by the first stirring member 44 is subjected to the magnetic forces of the magnetic-field generating end portion 52*n*; meanwhile, the parts of the helical blade, which face the magnetic-field generating end portion 52*n*, are formed to exert a high toner-conveying force. Thus, the toner in the first conveyance path 22*d* is conveyed at substantially the same speed. Accordingly, the toner uniformly circulates in the first conveyance path 22*d* and the second conveyance path 22*c*, and then in supplied to the developing roller 27. Thus, there is no risk of occurrence of image failures caused by density reduction, a ghost phenomenon, and the like.

The present invention can be used for a developing device used in an image forming apparatus such as an electrophotographic copier, a printer, a facsimile, and a multifunction peripheral having functions of those devices, and for an image forming apparatus provided with the developing device.

What is claimed is:

1. A developing device, comprising:

a developing roller incorporating a fixed magnet body having a plurality of magnetic poles in a circumferential direction, for supplying developer to a developing region facing an image carrier;

a regulating member for regulating an amount of developer on the developing roller so as to form a developer layer region on the developing roller by means of a magnetic field formed by the regulating member and the plurality of magnetic poles of the fixed magnet body, which face the regulating member; and a magnetic-field generating member for scraping off, on an upstream of the regulating member in a rotational direction of the developing roller, developer which is not used for development on the developing roller, wherein the following relation Bm/Br>1 is satisfied, where Bm represents a magnetic flux density of a distal end portion of the magnetic-field generating member facing a surface of the developing roller and Br represents a magnetic flux density of a distal end portion of the regulating member facing the surface of the developing roller.

2. A developing device according to claim 1, wherein the following relation 1.2>Bm/Br>1.8 is further satisfied.

3. A developing device according to claim 1, wherein the following relation Km/Kr<1 is satisfied, where Km represents an interval between the distal end portion of the magnetic-field generating member and the surface of the developing roller and Kr represents an interval between the distal end portion of the regulating member and the surface of the developing roller.

4. A developing device according to claim 3, wherein the following relation 0.3>Km/Kr>0.7 is further satisfied.

5. A developing device according to claim 1, wherein:

the magnetic-field generating member comprises:

a magnetic body facing the surface of the developing roller at a predetermined interval; and a magnet which comprises a facing magnetic pole facing one of the plurality of magnetic poles of the fixed magnet body, the magnet being attached to the magnetic body while facing the magnetic body in the rotational direction of the developing roller; and the facing magnetic pole of the magnet has the same polarity as that of the one of the plurality of magnetic poles of the fixed magnet body.

6. A developing device according to claim 5, wherein the magnetic body comprises a distal end portion facing the developing roller and an opposite facing portion on an opposite side to the distal end portion, and has a width in the circumferential direction of the developing roller smaller than a width of the opposite facing portion.

7. A developing device according to claim 1, wherein the magnetic-field generating member comprises a magnet facing one of the plurality of magnetic poles of the fixed magnet body at a predetermined interval with respect to the surface of the developing roller, the magnet facing the one of the plurality of magnetic poles of the fixed magnet body while having opposite polarity.

8. An image forming apparatus, comprising the developing device according to claim 1.

9. A developing device, comprising:

a developing roller incorporating a fixed magnet body having a plurality of magnetic poles in a circumferential direction, for supplying developer to a developing region facing an image carrier;

a regulating member for regulating an amount of developer on the developing roller so as to form a developer layer region on the developing roller by means of a magnetic field formed by the regulating member and the plurality of magnetic poles of the fixed magnet body, which face the regulating member; and a magnetic-field generating member for scraping off, on an upstream of the regulating member in a rotational direction of the developing roller, developer which is not used for development on the developing roller, wherein:

the magnetic-field generating member comprises:

magnetic-field generating end portions facing both-end-portions in a longitudinal direction of the developer layer region; and a magnetic-field generating central portion sandwiched in the longitudinal direction between the magnetic-field generating end portions; and an interval between each of the magnetic-field generating end portions and a surface of the developing roller is smaller than an interval between the magnetic-field generating central portion and the surface of the developing roller.

10. A developing device according to claim 9, wherein:

the magnetic-field generating member comprises:

a magnetic body facing the surface of the developing roller at a predetermined interval; and a magnet which comprises a facing magnetic pole facing the surface of the developing roller, the magnet being attached to the magnetic body while facing the magnetic body in the rotational direction of the developing roller;

the facing magnetic pole of the magnet has the same polarity as that of one of the plurality of magnetic poles of the fixed magnet body; and the interval between each of the magnetic-field generating end portions of the magnetic body and the surface of the developing roller is smaller than the interval between the magnetic-field generating central portion of the magnetic body and the surface of the developing roller.

11. A developing device according to claim 9, wherein:
the magnetic-field generating member comprises:
a magnetic body facing the surface of the developing roller at a predetermined interval; and
a magnet which comprises a facing magnetic pole facing the surface of the developing roller, the magnet being attached to the magnetic body while facing the magnetic body in the rotational direction of the developing roller;
the magnetic body extends to both-end-portions in the longitudinal direction of the developer layer region;
the magnet comprises a pair of magnets arranged so as to face the both-end-portions in the longitudinal direction of the developer layer region; and
the facing magnetic pole of each of the pair of magnets has the same polarity as that of one of the plurality of magnetic poles of the fixed magnet body; and
the interval between each of the magnetic-field generating end portions of the magnetic body and the surface of the developing roller is smaller than the interval between the magnetic-field generating central portion of the magnetic body and the surface of the developing roller.

12. A developing device according to claim 9, wherein:
the magnetic-field generating member comprises a magnetic body facing the surface of the developing roller at a predetermined interval;
the magnetic body faces one of the plurality of magnetic poles of the fixed magnet body; and
the interval between each of the magnetic-field generating end portions of the magnetic body and the surface of the developing roller is smaller than the interval between the magnetic-field generating central portion of the magnetic body and the surface of the developing roller.

13. A developing device according to claim 9, wherein:
the regulating member comprises:
end-portion regulating portions facing the both-end-portions in the longitudinal direction of the developer layer region; and
a central regulating portion sandwiched in the longitudinal direction between the end-portion regulating portions;
each of the end-portion regulating portions has a magnetic force higher than a magnetic force of the central regulating portion; and
the magnetic-field generating end portions of the magnetic-field generating member are formed so as to face the developer layer region while including a part of the developer layer region, the part corresponding to a boundary between each of the end-portion regulating portions and the central regulating portion.

14. A developing device, comprising:
a developing roller incorporating a fixed magnet body having a plurality of magnetic poles in a circumferential direction, for supplying developer to a developing region facing an image carrier;
a regulating member for regulating an amount of developer on the developing roller so as to form a developer layer region on the developing roller by means of a magnetic field formed by the regulating member and the plurality of magnetic poles of the fixed magnet body, which face the regulating member; and
a magnetic-field generating member for scraping off, on an upstream of the regulating member in a rotational direction of the developing roller, developer which is not used for development on the developing roller, wherein:
the magnetic-field generating member comprises:
magnetic-field generating end portions facing both-end-portions in a longitudinal direction of the developer layer region; and
a magnetic-field generating central portion sandwiched in the longitudinal direction between the magnetic-field generating end portions; and
each of the magnetic-field generating end portions has a magnetic force higher than a magnetic force of the magnetic-field generating central portion.

15. A developing device according to claim 14, wherein:
the magnetic-field generating member comprises:
a magnetic body facing a surface of the developing roller; and
a magnet which comprises a facing magnetic pole facing the surface of the developing roller, the magnet being attached to the magnetic body while facing the magnetic body in the rotational direction of the developing roller;
the facing magnetic pole of the magnet has the same polarity as that of one of the plurality of magnetic poles of the fixed magnet body; and
the magnet has a magnetic force higher on magnetic-field-generating-end-portion sides than a magnetic force on a magnetic-field-generating-central-portion side of the magnet.

16. A developing device according to claim 14, wherein:
the magnetic-field generating member comprises:
a magnetic body facing the surface of the developing roller; and
a magnet which comprises a facing magnetic pole facing the surface of the developing roller, the magnet being attached to the magnetic body while facing the magnetic body in the rotational direction of the developing roller;
the magnetic body extends to both-end-portions in the longitudinal direction of the developer layer region;
the magnet comprises a pair of magnets arranged so as to face the both-end-portions in the longitudinal direction of the developer layer region; and
the facing magnetic pole of each of the pair of magnets has the same polarity as that of one of the plurality of magnetic poles of the fixed magnet body.

17. A developing device according to claim 14, wherein:
the regulating member comprises:
end-portion regulating portions facing the both-end-portions in the longitudinal direction of the developer layer region; and
a central regulating portion sandwiched in the longitudinal direction between the end-portion regulating portions;
each of the end-portion regulating portions has a magnetic force higher than a magnetic force of the central regulating portion; and
the magnetic-field generating end portions of the magnetic-field generating member are formed so as to face the developer layer region while including a part of the developer layer region, the part corresponding to a boundary between each of the end-portion regulating portions and the central regulating portion.

18. A developing device according to claim 14, further comprising:
a first stirring member facing the developing roller, for supplying the developer;
a second stirring member for stirring and conveying the developer together with the first stirring member;
a first conveyance path in which the developer is conveyed by the first stirring member;

a second conveyance path which is arranged in parallel with the first conveyance path and in which the developer is conveyed by the second stirring member;

a first communication portion for allowing the developer to flow from the first conveyance path to the second conveyance path; and a second communication portion for allowing the developer to flow from the second conveyance path to the first conveyance path, wherein:

the magnetic-field generating member is arranged between the developing roller and the first stirring member; and the first communication portion is arranged at a position not facing the magnetic-field generating member.

19. A developing device according to claim 18, wherein:

the first stirring member comprises a rotary shaft and a helical blade formed about the rotary shaft; and a part of the helical blade, which faces each of magnetic-field generating end portions of the magnetic-field generating member, is formed to exert a high developer-conveying force.

20. A developing device, comprising:

a developing roller incorporating a fixed magnet body having a plurality of magnetic poles in a circumferential direction, for supplying developer to a developing region facing an image carrier;

a regulating member for regulating an amount of developer on the developing roller so as to form a developer layer region on the developing roller by means of a magnetic field formed also by the plurality of magnetic poles of the fixed magnet body, which face the regulating member; and a magnetic-field generating member for scraping off, on an upstream of the regulating member in a rotational direction of the developing roller, developer which is not used for development on the developing roller, wherein the magnetic-field generating member comprises a pair of magnetic-field generating members arranged so as to face both-end-portions in a longitudinal direction of the developer layer region, the pair of magnetic-field generating members respectively having inner surface portions arranged so as to face each other in the developer layer region, and outer surface portions arranged out of the developer layer region or arranged so as to face boundaries of the developer layer region.

21. A developing device according to claim 20, wherein the inner surface portion of each of the pair of magnetic-field generating members is inclined to a central side in the longitudinal direction from the upstream to a downstream in the rotational direction of the developing roller.

22. A developing device according to claim 20, wherein the inner surface portion of each of the pair of magnetic-field generating members is provided with an inclined surface forming a predetermined angle with respect to a surface of the developing roller, the predetermined angle of the inclined surface being smaller from the upstream to a downstream in the rotational direction of the developing roller.

23. A developing device according to claim 20, wherein each of the pair of magnetic-field generating members comprises a magnet having a facing magnetic pole facing a surface of the developing roller, the facing magnetic pole of the magnet having the same polarity as that of one of the plurality of magnetic poles of the fixed magnet body facing the facing magnetic pole.

24. A developing device according to claim 20, wherein each of the pair of magnetic-field generating members comprises a magnet having a facing magnetic pole facing a surface of the developing roller, and a magnetic body attached to the magnet while facing the magnet in the rotational direction of the developing roller, the facing magnetic pole of the magnet having the same polarity as that of one of the plurality of magnetic poles of the fixed magnet body.

* * * * *